US005739456A

United States Patent [19]

Shimada

[11] Patent Number: 5,739,456

[45] Date of Patent: Apr. 14, 1998

[54] METHOD AND APPARATUS FOR PERFORMING AUTOMATIC ACCOMPANIMENT BASED ON ACCOMPANIMENT DATA PRODUCED BY USER

[75] Inventor: Yoshihisa Shimada, Hamamatsu, Japan

[73] Assignee: Kabushiki Kaisha Kawai Gakki Seisakusho, Shizuoka-ken, Japan

[21] Appl. No.: 713,372

[22] Filed: Sep. 11, 1996

[30] Foreign Application Priority Data

Sep. 29, 1995 [JP] Japan ..... 7-276781

[51] Int. Cl.[6] ..... G10H 1/06; G10H 1/38; G10H 1/40

[52] U.S. Cl. ..... 84/622; 84/636; 84/637; 84/DIG. 12; 84/DIG. 22

[58] Field of Search ..... 84/602, 609–614, 84/622–625, 634–638, 649–652, 659–661, 666–669, DIG. 12, DIG. 22

[56] References Cited

U.S. PATENT DOCUMENTS

| | | | |
|---|---|---|---|
| 4,881,440 | 11/1989 | Kakizaki | 84/DIG. 22 |
| 5,270,477 | 12/1993 | Kawashima | 84/635 X |
| 5,340,939 | 8/1994 | Kumagai | 84/609 |
| 5,369,216 | 11/1994 | Miyamoto | 84/609 |
| 5,457,282 | 10/1995 | Miyamoto et al. | 84/634 |
| 5,483,018 | 1/1996 | Aoki et al. | 84/611 |
| 5,576,506 | 11/1996 | Kawashima et al. | 84/602 |

*Primary Examiner*—Stanley J. Witkowski
*Attorney, Agent, or Firm*—Christie, Parker & Hale, LLP

[57] ABSTRACT

In a method for automatically performing accompaniment in an automatic accompaniment apparatus, a plurality of system defining rhythm data patterns are provided. Each of the plurality of system rhythm data patterns is composed of a plurality of rhythm data for a plurality of parts. In a rhythm editing mode, one or more parts of the plurality of parts of the user rhythm data pattern is designated for a user defining rhythm data pattern, and the designated one or more parts are associated with the rhythm data of corresponding parts of one of the plurality of system defining rhythm data patterns so that the user defining rhythm data pattern can be produced. In an automatic accompaniment mode, accompaniment is automatically performed based on the user defining rhythm data pattern. Each of the plurality of rhythm data has a rhythm data identifier and a pattern identifier is allocated to each of the plurality of system defining rhythm data patterns. Each part of each system defining rhythm data pattern is related to the corresponding rhythm data using the rhythm delta identifier. Thus, by specifying a pattern identifier and one or more parts, the specified one or more parts of the user defining rhythm data pattern can be related to the rhythm data.

14 Claims, 16 Drawing Sheets

Fig. 5

| RHYTHM NO. | USER DEFINING RHYTHM DATA PATTERN | ASSOCIATED RHYTHM NO. | CHORD PROGRESS DATA NO. | |
|---|---|---|---|---|
| 100 | CHORD RHYTHM NO. | 0 | 0 | |
| | BASS RHYTHM NO. | 1 | 1 | |
| | DRUM RHYTHM NO. | 1 | 1 | |
| | CHORD TIMBRE NO. | 18 | | USER DEFINITION INITIAL DATA |
| | BASS TIMBRE NO. | 20 | | |
| | TEMPO DATA | 24 | | |
| 101 | CHORD RHYTHM NO. | 1 | 1 | |
| | BASS RHYTHM NO. | 1 | 1 | |
| | DRUM RHYTHM NO. | 2 | 2 | |
| | CHORD TIMBRE NO. | 1 | | |
| | BASS TIMBRE NO. | 2 | | |
| | TEMPO DATA | 20 | | |
| 102 | CHORD RHYTHM NO. | | | |
| | BASS RHYTHM NO. | | | |
| | DRUM RHYTHM NO. | | | |
| | CHORD TIMBRE NO. | | | |
| | | | | |
| | | | | |
| 199 | CHORD RHYTHM NO. | | | |
| | BASS RHYTHM NO. | | | |
| | | | | |
| | | | | |
| | BASS TIMBRE NO. | | | |
| | TEMPO DATA | | | |

Fig. 7

| RHYTHM NO. | USER DEFINING RHYTHM DATA PATTERN | ASSOCIATED RHYTHM NO. | CHORD PROGRESS DATA NO. | |
|---|---|---|---|---|
| 100 | CHORD 1 RHYTHM NO. | 2 | 2 | |
| | CHORD 2 RHYTHM NO. | 1 | 1 | |
| | CHORD 3 RHYTHM NO. | 2 | 2 | |
| | BASS RHYTHM NO. | 1 | 1 | |
| | BASS DRUM RHYTHM NO. | 3 | | |
| | SNARE DRUM RHYTHM NO. | 1 | | |
| | HI-HAT RHYTHM NO. | 2 | | |
| | SUB-DRUM 1 RHYTHM NO. | 1 | | |
| | SUB-DRUM 2 RHYTHM NO. | 1 | | |
| | CHORD 1 TIMBRE NO. | 5 | | USER DEFINITION INITIAL DATA |
| | CHORD 2 TIMBRE NO. | 4 | | |
| | CHORD 3 TIMBRE NO. | 3 | | |
| | BASS TIMBRE NO. | 5 | | |
| | TEMPO DATA | 25 | | |
| 102 | CHORD 1 RHYTHM NO. | | | |
| | CHORD 2 RHYTHM NO. | | | |
| | | | | |
| | | | | |
| | TEMPO DATA | | | |
| 199 | CHORD 1 RHYTHM NO. | | | |
| | CHORD 2 RHYTHM NO. | | | |
| | | | | |
| | | | | |
| | BASS TIMBRE NO. | | | |
| | TEMPO DATA | | | |

METHOD AND APPARATUS FOR PERFORMING AUTOMATIC ACCOMPANIMENT BASED ON ACCOMPANIMENT DATA PRODUCED BY USER

BACKGROUND OF THE INVENTION

1. Field of the Invention

The present invention relates to the field of an electronic musical instrument, and more particularly to a method and apparatus for performing automatic accompaniment based on the accompaniment data produced by a user.

2. Description of Related Art

In recent years, an automatic accompaniment apparatus has been incorporated into electronic musical instruments such as an electronic keyboard, an electronic organ, an electronic piano and so on. By using the automatic accompaniment apparatus, a user can enjoy performance by playing, for example, a melody or the like with an automatically performed accompaniment sound as the background. Such an automatic accompaniment apparatus includes an automatic accompaniment data pattern memory (hereinafter, referred to as "a pattern memory") which is composed of a ROM. The accompaniment data pattern (hereinafter, referred to as "a system defining rhythm data pattern"), which has been incorporated into the system to perform the automatic accompaniment from one measure to a few measures, is stored for every kind of rhythm in the pattern memory. When the user selects a rhythm data pattern and then instructs the start of automatic accompaniment corresponding to the selected rhythm data pattern, a control section of the automatic accompaniment apparatus repeatedly reads out the instructed system defining rhythm data pattern from the pattern memory. The sound generation of the instructed accompaniment is performed based on the read out rhythm data pattern. In this manner, the automatic accompaniment sound of the selected rhythm is performed.

In a conventional automatic accompaniment apparatus, the rhythm data pattern is generally provided from the manufacturer and stored in the pattern memory. However, the user can perform automatic accompaniment only using the accompaniment data which is provided from the manufacturer. However, a lot of users are satisfied with the rhythm data patterns provided from the manufacturer. Therefore, there is a strong need to produce a desired rhythm data pattern and to perform the produced rhythm data pattern.

However, in order to produce the rhythm data pattern, the ability to play to some extent and some musical knowledge are required. Therefore, it is not easy for general users to produce a satisfactory rhythm data pattern. It is especially difficult for beginners to produce a desired rhythm data pattern.

Also, if a melody is performed with automatic accompaniment as the background, it is necessary to change the chord progression of the accompaniment to match the chord progression of the melody. There is a conventionally known an electronic music instrument in which a chord can be designated using a part of the keyboard, e.g., lower keys, for this purpose. In this electronic music instrument, the melody is performed using the upper keys while the chords are designated using the lower keys. However, this is a problem because it is difficult for a beginner to perform the melody at the same time as the chords are designated.

SUMMARY OF THE INVENTION

Therefore, the present invention is made in the light of the above-mentioned circumstances, and provides a method and apparatus in which a user can simply produce a desired matching automatic accompaniment data even if the user is a beginner.

The present invention provides a method and apparatus in which a user defining rhythm data pattern can be easily produced from system defining rhythm data patterns provided by a manufacturer.

The present invention also provides a method and apparatus in which accompaniment sound currently designated can be heard during an edit operation, timbre and tempo can be designated, and further automatic accompaniment can be performed in accordance with a designated chord progression.

In order to achieve one aspect of the present invention, a method of automatically performing an accompaniment produced by a user in an automatic accompaniment apparatus includes the steps of:

providing a plurality of system defining rhythm data patterns, each of the plurality of system defining rhythm data patterns including rhythm data for each of a plurality of parts;

Designating at least one part of a plurality of parts of a user defining rhythm data pattern in a rhythm edit mode, and associating the designated at least one part with the rhythm data of a corresponding part of one of the plurality of system defining rhythm data patterns to produce the user defining rhythm data pattern; and automatically performing an accompaniment in an automatic accompaniment mode based on the user rhythm data pattern.

It is preferable that each of a plurality of the rhythm data has a rhythm data identifier, and the plurality of system defining rhythm data patterns are allocated with pattern identifiers, respectively, and each of the plurality of parts of each of the plurality of system defining rhythm data patterns is related to the corresponding rhythm data using the rhythm data identifier. In this case, the at least one part of the plurality of parts of the user defining rhythm data pattern may be designated in the rhythm edit mode and the pattern identifier for the at least one part associates the designated at least one part with the rhythm data using the designated pattern identifier. Also, by allocating and specifying a unique pattern identifier to the user rhythm data pattern in the rhythm edit mode, the accompaniment may be automatically performed based on the user defining rhythm data pattern corresponding to the pattern identifier currently specified in the automatic accompaniment mode. Further, the pattern identifier of a desired one of a plurality of the user defining rhythm data patterns which are already produced can be specified to allow the automatic accompaniment performance based on the desired user defining rhythm data pattern.

In the present invention, because the accompaniment can be automatically performed based on the user defining rhythm data pattern corresponding to the pattern identifier currently specified in the rhythm edit mode, a user can confirm that the user defining rhythm data pattern corresponding to the pattern identifier currently specified is valid.

In the rhythm edit mode, timbres and tempo may be specified for the user defining rhythm data pattern.

Further, the accompaniment may be automatically performed in the automatic accompaniment mode based on the user defining rhythm data pattern using chord progress data associated with at least one of a chord part and a bass part. Alternatively, chord progress data to which a chord identifier is allocated may be provided and the chord identifier may be specified for the at least one part when the at least one part is at least one of a chord part and a bass part, such that the accompaniment is automatically performed in the automatic accompaniment mode based on the produced user defining rhythm data pattern using the chord progress data specified by the chord identifier.

In order to achieve another aspect of the present invention, an automatic accompaniment apparatus includes a first storage section for storing a plurality of system defining rhythm data patterns, each of the plurality of system defining rhythm data patterns including a rhythm data for each of a plurality of parts, a producing section for designating at least one of the plurality of parts in response to an input from a user in an edit mode, and producing a rhythm data for the at least one part from the plurality of system defining rhythm data patterns to produce a user defining rhythm data pattern, and a performing section for automatically performing an accompaniment based on the user defining rhythm data pattern in an automatic accompaniment mode.

BRIEF DESCRIPTION OF THE DRAWINGS

FIG. 5 is a diagram showing the data structure of a first example of the user defining rhythm data patterns which are stored in the RAM 12 used in the electronic musical instrument shown in FIG. 1;

FIG. 7 is a diagram showing the data structure of a second example of the user defining rhythm data patterns which are stored in the RAM 12 used in the electronic musical instrument shown in FIG. 1;

DESCRIPTION OF THE PREFERRED EMBODIMENT

The automatic accompaniment apparatus of the present invention will be described below in detail with reference to the accompanying drawings. Note that the automatic accompaniment apparatus may be provided as an independent automatic accompaniment apparatus, or may be incorporated into an electronic musical instrument.

Figure 1:
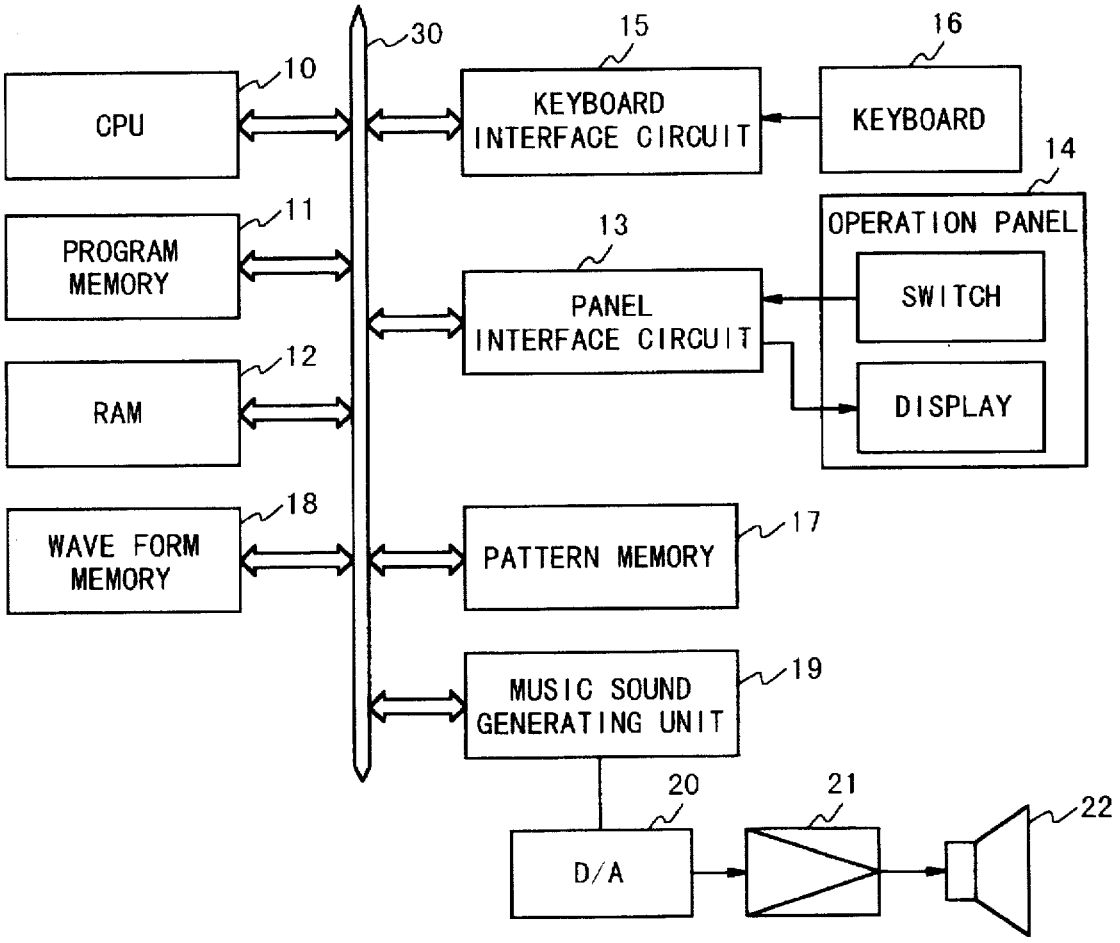
FIG. 1 is a block diagram showing the structure of an electronic musical instrument to which an automatic accompaniment apparatus according to an embodiment of the present invention is applied.

FIG. 1 is a schematic block diagram showing the structure of the electronic musical instrument to which the automatic accompaniment apparatus of the present invention is applied. The electronic musical instrument is composed of a CPU 10, program memory 11, RAM 12, panel interface circuit 13, operation panel 14 including switches, a display and indicators, keyboard interface circuit 15, keyboard 16, pattern memory 17, wave form memory 18, music sound generating unit 19, digital-analog (D/A) converter 20, amplifier 21, and speaker 22.

The CPU 10, program memory 11, RAM 12, panel interface circuit 13, keyboard interface circuit 15, pattern memory 17, wave form memory 18 and music sound generating unit 19 are connected to each other via a system bus 30. The system bus is composed of an address bus, a data bus and a control signal bus and is used to transmit and receive a data between the above-mentioned components.

The CPU 10 operates in accordance with a control program stored in the program memory 11 to control each of the components of the electronic musical instrument. For example, the program memory 11 is composed of a ROM. Predetermined data which are used for various types of processing by the CPU 10 are stored in the program memory 11 in addition to the above-mentioned control program. Further, a plurality of timbre parameters are stored in the program memory 11 for different kinds of musical instruments and the ranges of timbres. Each of the timbre parameters is composed of a wave form address, frequency data, envelope data, and filter coefficients. Note that the program memory 11 may be composed of a RAM. In such a case, the electronic musical instrument is designed to load the control program, timbre parameters from a storage medium such as a floppy disk, optical disk, and CD-ROM into the RAM when a power switch is turned on.

A keyboard 16 is connected to the keyboard interface circuit 15. The keyboard 16 has a plurality of keys to designate sound heights. In the keyboard 16, for example, the key of a 2-switch type is used. More particularly, each key of the keyboard 16 has two key switches which are respectively turned on at different push depths and detects a key pushing event and a key releasing event. The keyboard interface circuit 15 controls exchange of data between the keyboard 16 and the CPU 10. The exchange of data is performed in accordance with the following procedure. That is, the keyboard interface circuit 15 sends out a scan signal to the keyboard 16 in accordance with an instruction from the CPU 10. The keyboard 16 replies to return a keyboard scan signal indicative of the on or off state of each key switch to the keyboard interface circuit 15 in response to the scan signal. The keyboard interface circuit 15 generates keyboard data based on the keyboard scan signal which is received from the keyboard 16. The keyboard data is composed of key data which is composed of a sequence of bits indicative of the on or off state of each key and touch data indicative of the strength or speed of the key touch. The keyboard data generated by the keyboard interface circuit 15 is sent to the CPU 10. The CPU 10 can determine, based on the keyboard data, which key has been pushed with how much strength or which key has been released.

Figure 4:
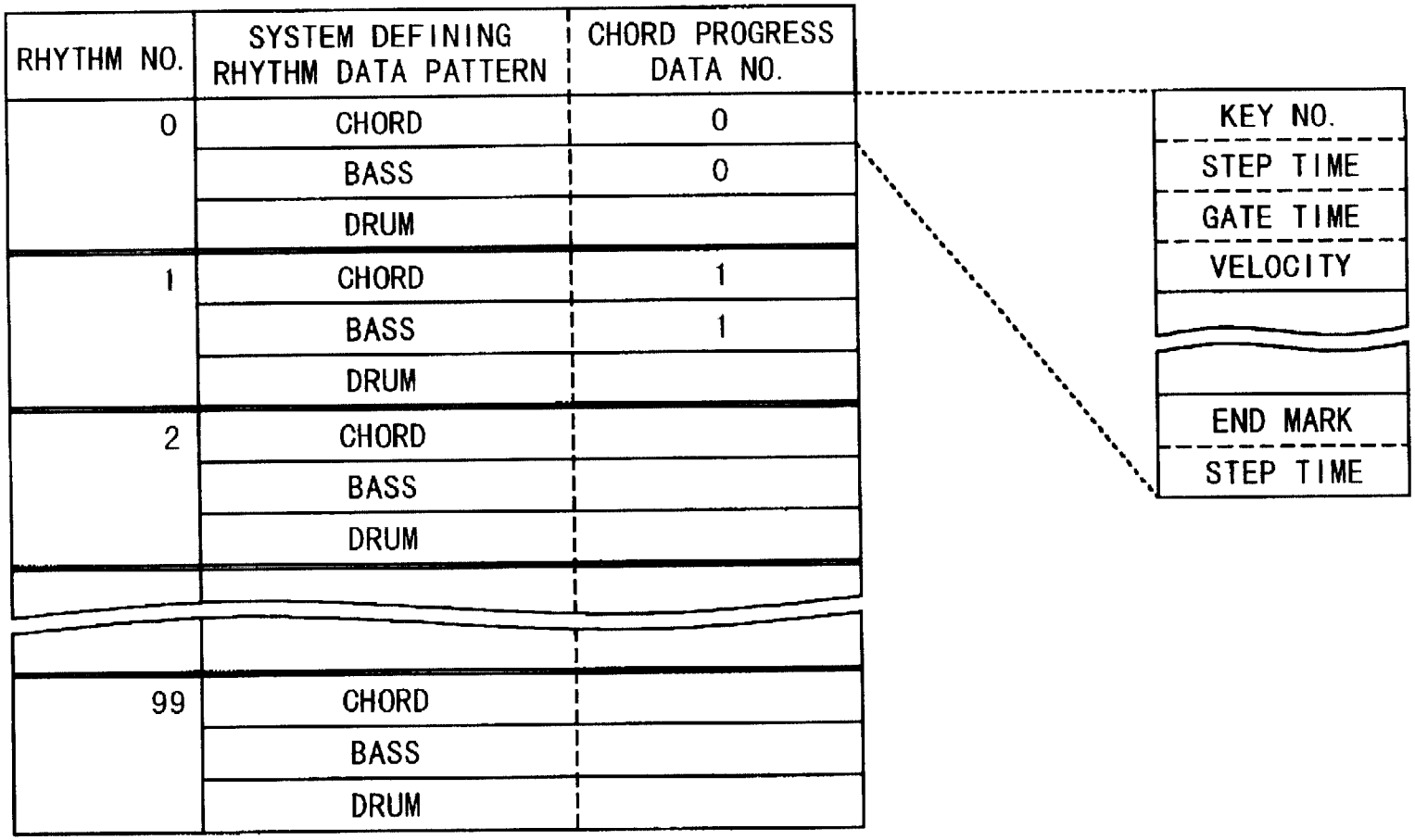
FIG. 4 is a diagram showing the data structure of a first example of the system defining rhythm data patterns which are stored in a pattern memory 17 used in the electronic musical instrument shown in FIG. 1.
Figure 8:
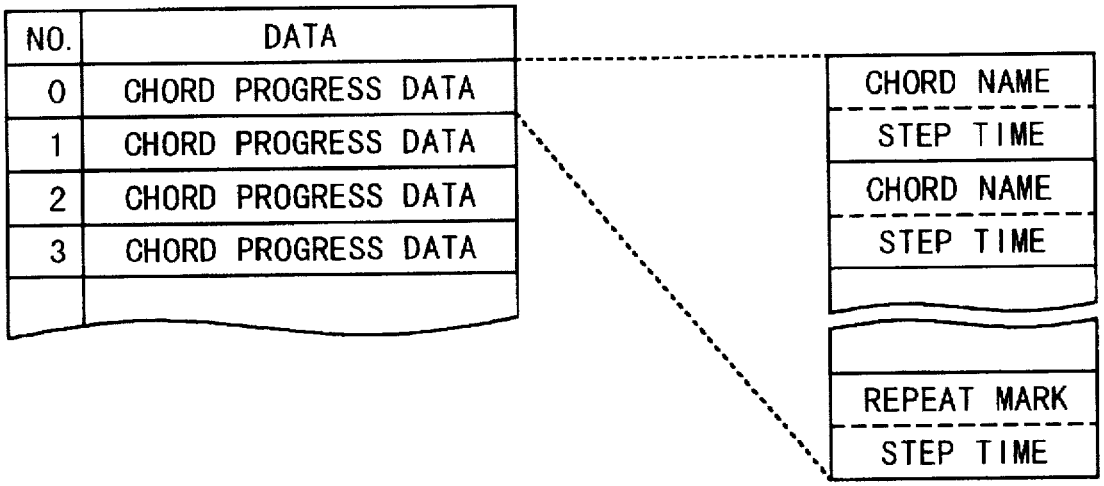
FIG. 8 is a diagram showing the data structure of a chord progression data which are stored in the pattern memory 17 used in the electronic musical instrument shown in FIG. 1.

The pattern memory 17 is composed of a ROM. However, the pattern memory 17 may be provided in the form of an IC card. The pattern memory 17 stores a plurality of system defining rhythm data patterns and the chord progress data respectively associated therewith. Each of the plurality of system defining rhythm data patterns is stored for every system defining rhythm. In the present embodiment, 100 system defining rhythm data patterns incorporated into the automatic accompaniment apparatus by the manufacturer are stored in the pattern memory 17 for automatic accompaniment, as shown in FIG. 4. The chord progress data is data which instructs the change of chords in the automatic accompaniment, and is composed as shown in FIG. 8. The details of the system defining rhythm data pattern and chord progress data will be described later. Note that the pattern memory 17 may be composed of a RAM. In such a case, for example, the electronic musical instrument is instructed to load the system defining rhythm data patterns, system definition initial data and chord progress data from a floppy disk, optical disk, or CD-ROM to the RAM when the power is turned on.

Next, the system defining rhythm data pattern which is stored in the pattern memory 17 will be described in detail.

The system defining rhythm data patterns are grouped and stored in the pattern memory 17 for every system defining rhythm, as the first example shown in FIG. 4. In this description, the structure and operation of the electronic musical instrument will be described, taking the first example of system defining rhythm data pattern as an example, if excluding any special case:

The rhythm numbers of 0 to 99 are allocated to the system defining rhythm data patterns, respectively. Note that the rhythm numbers of the system defining rhythm data patterns are not limited to the above-example and it is possible to set them optionally. Each system defining rhythm data pattern is composed of three fields of the chord part, bass part and drum part, in each of these fields are stored a sequence of note data for generation of a corresponding accompaniment sound. Note that initial timbres of the accompaniment sounds of the chord part and base part and an initial tempo are designated by a system definition initial data (not shown), which is also stored in the pattern memory 17. The system definition initial data is loaded in advance in registers of the RAM 12 to be described later when the automatic accompaniment is performed based on a selected system defining rhythm data pattern. The system definition initial data is changeable. Each of the chord part and bass part is allocated with a field for storing a chord progress data number associated with the part. Each of the note data of the sequence is composed of a 4-byte data, i.e., a 1-byte key number data, 1-byte step time data, 1-byte gate time data, and 1-byte velocity data, as shown in FIG. 4. Each note data is used to generate one sound. The key number data is data which designates a sound height, and the step time data is data which specifies a timing of sound generation. The gate time data is data which designates the duration of the sound generation, and velocity data is data which specifies the strength of the generated sound.

Also, the last note data of the sequence of note data in each part is composed of 2-byte data, i.e., a 1-byte end mark data and 1-byte steptime data. The last note data is used to indicate the end of each port. Note that the key number data and the end mark data are both located in the first byte of the note data and they are distinguished from each other based on whether the MSB of the first byte is "0" or "1"

Next, the detail of the Chord progress data which are stored in the pattern memory 17 will be described below. The chord progress da~a are associated with each of the chord part and bass part of each system defining rhythm data pattern. As shown in FIG. 8, each chord progress data is composed of a plurality of data sets. Each data set is composed of 2-byte data, i.e., a 1-byte chord name data and a 1-byte step time data. Each data set is referred to as a "chord change instruction data". Each chord change instruction data is used to give a kind and a change timing of a chord. For example, the chord name data is composed of a chord type and a chord route. The chord name data is used to specify the kind of chord. The step time data is used to specify a change timing.

Also, in the end of a sequence of chord change instruction data, a special chord change instruction data is provided which is composed of a 1-byte repeat mark and a 1-byte step time data. The special chord change instruction data is used to indicate the end of the chord progress data. Note that the chord name and the repeat mark data are both located in the first byte of the data set. They are distinguished from each Other based on whether the MSB of the first byte is "0" or "1"

Figure 6:
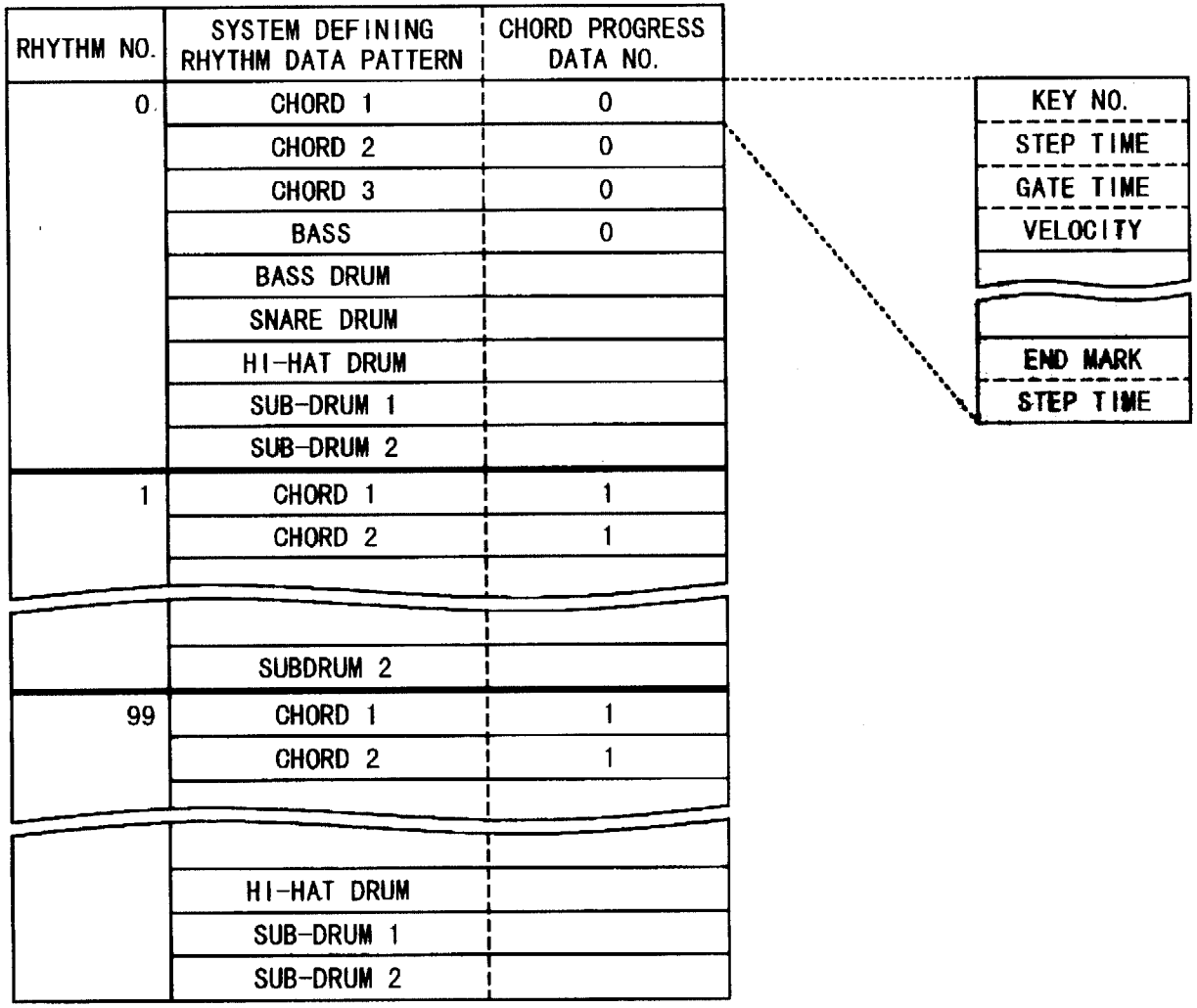
FIG. 6 is a diagram showing the data structure of a second example of the system defining rhythm data patterns which are stored in the pattern memory 17 used in the electronic musical instrument shown in FIG. 1.

The second example of system defining rhythm data pattern shown in FIG. 6 may be used in place of the first example of system defining rhythm data pattern shown in FIG. 4. The second example of system defining rhythm data pattern is composed of a chord 1 part, chord 2 part, chord 3 part, bass part, bass drum part, snare drum part, hi-hat part, sub-drum 1 part and sub-drum 2 part. Each part is composed of a sequence of note data, as in the first example of system defining rhythm data pattern. In the second example of system defining rhythm data pattern, sequences of note data of the chord 1 to 3 parts are used to generate the accompaniment sounds of corresponding chord parts, respectively. That is, the accompaniment sounds of these chord 1 to 3 parts are generated at the same time in different timbres and rhythms and the generated accompaniment sounds are synthesized into one chord part as a whole. The bass part is used to generate the accompaniment sound of the bass part as described above. By generating accompaniment sounds of the bass drum part, snare drum part and hi-hat part at the same time, the accompaniment sound of the whole drum part is generated with the timbres of a drum set. The sub-drum 1 part and sub-drum 2 part are used to generate the accompaniment sounds of the tom tom, cymbal, percussion and so on.

The RAM 12 has a data pattern area to store a plurality of user defining rhythm data patterns which are produced by the user. The plurality of user defining rhythm data patterns are stored in the data pattern area for every user defining rhythm. In the embodiment, for example, 100 user defining rhythm data patterns can be defined, as shown in FIGS. 5 or 7. The rhythm numbers of 100 to 199 are allocated to the respective user defining rhythm data patterns. Note that the rhythm numbers and the number of the user defining rhythm data patterns are not limited to the above and it is possible to set them to arbitrary values.

The user defining rhythm data pattern will be described below in detail. For example, as shown in the first example of FIG. 5, the user defining rhythm data patterns are stored for every user rhythm in the data pattern area of the RAM 12. The user defining rhythm data pattern shown in FIG. 5 is applied to the automatic accompaniment apparatus in which the system defining rhythm data pattern shown in FIG. 4 is used. Each user defining rhythm data pattern is composed of a chord rhythm number field, a bass rhythm number field, a drum rhythm number field, a chord timbre number field, a bass timbre number field and a tempo data field. In each of the chord, bass and drum rhythm number fields is stored as an associated rhythm number the rhythm number of a selected one of the plurality of system defining rhythm data pattern patterns to be associated with a corresponding one of the chord part, bass part and drum part, as well as a chord progress data number which is related to the corresponding part of the associated system defining rhythm data pattern. Also, in the chord timbre number field, bass timbre number field and tempo data field are stored the data indicative of the timbres of the corresponding parts of the selected user defining rhythm data patterns, and the data indicative of the tempo thereof. These data are collectively referred to as a "user definition initial data" hereinafter. The user definition initial data are stored for every user defining rhythm in the data pattern area with a rhythm number in addition to the associated rhythm numbers of the various parts at the time when a storage switch STORE is pushed, as described later. In this manner, not a sequence of note data but one rhythm number of the system defining rhythm data pattern to which the corresponding part belongs is stored in each of the chord, bass and drum rhythm number fields. Therefore, a small data area is only required to be reserved as the pattern data area. Also, the user can easily produce the user defining rhythm data pattern only by associating one of the system defining rhythm data patterns to each part of the user defining rhythm data pattern.

If one rhythm number of one of the plurality of user defining rhythm data patterns is designated in the automatic accompaniment, there are read out a sequence of note data of the corresponding part of the system defining rhythm data pattern which is designated by the associated rhythm number of each part of the designated user defining rhythm data pattern, and the accompaniment sound of the part is generated based on the sequence of note data. For instance, if "100" is specified as the rhythm number, the sequence of note data of the chord part of the system defining rhythm data pattern having the associated rhythm number of "0" is read out and the automatic accompaniment of the chord part is performed based on the read sequence of note data. The same operation is performed on the bass part and drum part. The user definition initial data is set in predetermined registers before the automatic accompaniment is started.

The user defining rhythm data pattern may be provided as shown in the second example of FIG. 7. The user defining rhythm data pattern shown in FIG. 7 is applied to the automatic accompaniment apparatus in which the system defining rhythm data pattern shown in FIG. 6 is used. Each user defining rhythm data pattern is composed of fields of a chord 1 rhythm number, chord 2 rhythm number, chord 3 rhythm number, bass rhythm number, bass drum rhythm number, snare drum rhythm number, hi-hat rhythm number, sub-drum 1 rhythm number, sub-drum 2 rhythm number, chord 1 timbre number, chord 2 timbre number, chord 3 timbre number, bass timbre number and tempo data. The chord 1 rhythm number, chord 2 rhythm number, chord 3 rhythm number, bass rhythm number, bass drum rhythm number, snare drum rhythm number, hi-hat rhythm number, sub-drum 1 rhythm number, and sub-drum 2 rhythm number correspond to those of a system defining rhythm data pattern, and store as the associated rhythm numbers, the rhythm numbers of designated ones of the plurality of system defining rhythm data patterns, respectively. Also, the user definition initial data is composed of the chord 1 timbre number data, chord 2 timbre number data, chord 3 timbre number data, bass timbre number data and tempo data, which respectively correspond to the data indicative of the timbres of the chord 1 part, chord 2 part, chord 3 part and indicative of the tempo. These data are stored as the user definition initial data at the time when the storage switch STORE is pushed.

If the rhythm number of one of the plurality of user defining rhythm data patterns is designated in the automatic accompaniment, there are read out ones of the plurality of system defining rhythm data patterns which are designated by the associated rhythm numbers of the parts of the designated user defining rhythm data pattern, and the accompaniment sound of the parts is generated based on the read system defining rhythm data patterns. For instance, in a case where "100" is specified as the rhythm number, if "2" is stored in the chord 1 rhythm number field as the associated rhythm number, a sequence of note data of the chord 1 part of the system defining rhythm data pattern having the rhythm number of "2" is read out and the automatic accompaniment of the chord 1 part is performed based on the read sequence of note data. The same operation is performed on the chord 2 part, chord 3 part, bass part and bass drum part, snare drum part, hi-hat drum part, sub-drum 1 part and sub-drum 2 part. The user definition initial data is set to predetermined registers before the automatic accompaniment is started, as in the first example.

Figure 3:
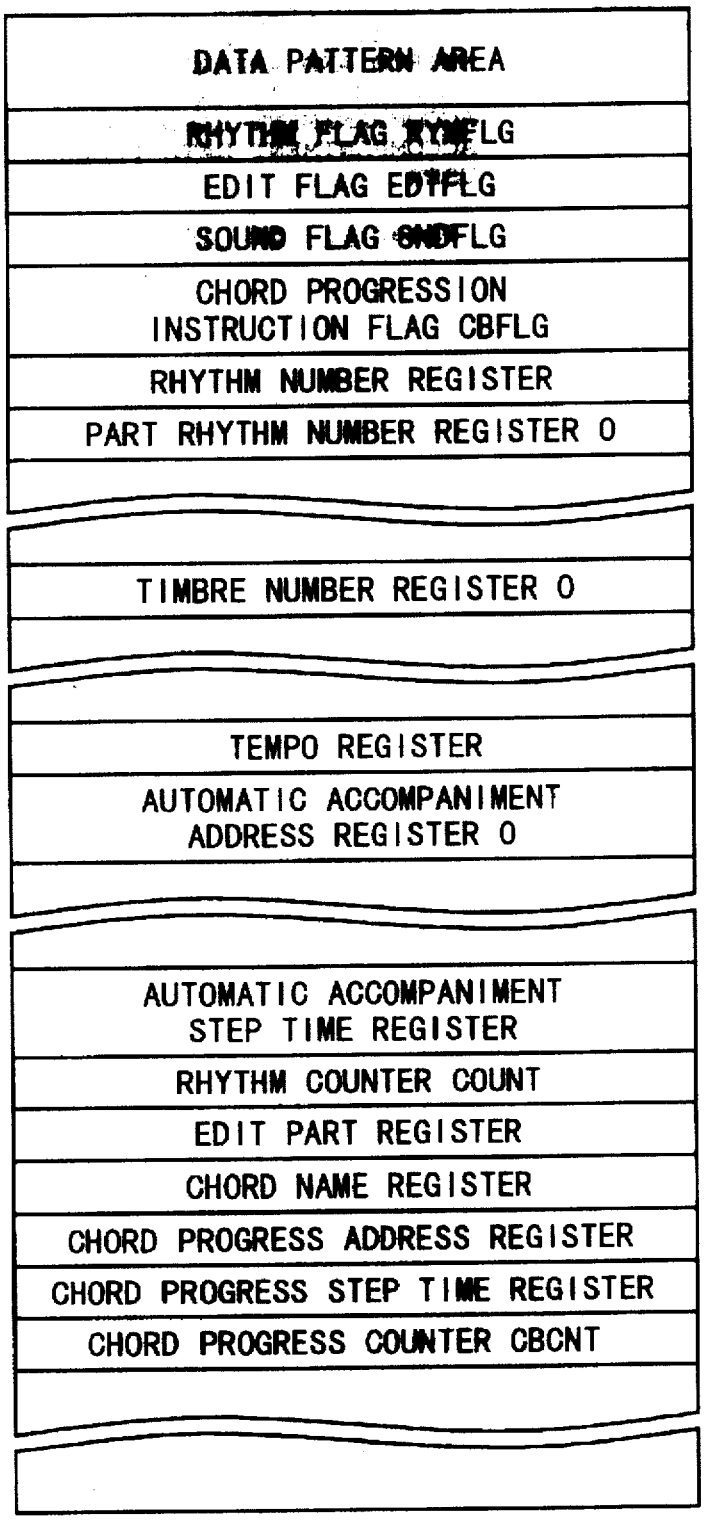
FIG. 3 is a diagram showing the allocation of a memory area of a RAM 12 which is used in the electronic musical instrument shown in FIG. 1.

In addition, the RAM 12 is used to store various data temporarily. For instance, buffers, registers, counters, flags and so on are defined in the RAM 12, as shown in FIG. 3. Main ones of the buffers, registers, counters, and flags provided in the RAM 12 in a case that the firsts'example of system defining rhythm data pattern is used will be described below with reference to FIG. 3. Registers or the like other than those described below will be described when necessary.

(a) A data pattern area: is the area to store a plurality of user defining rhythm data patterns which are produced by a user as shown in FIG. 5 or 7 for every user defining rhythm;

(b) A rhythm flag RYMFLG: is the flag indicative of whether or not automatic accompaniment is being performed (it is reversed every time the start/stop switch START/STOP is pushed, and indicates by "0" that it is not on the automatic accompaniment and by "1" that it is on the automatic accompaniment);

(c) An edit flag EDTFLG: is the flag indicative of whether or not the control is in the edit mode (the control is in the edit mode when "1" and is not in the edit mode when "0");

(d) A sound flag SNDFLG: is the flag indicative of whether the control is in the timbre selection mode or the rhythm selection mode (the control is in the timbre selection mode when "1" and is not in the rhythm selection mode when "0");

(e) A chord progress instruction flag CBFLG: is the flag indicative of whether or not the control is in the chord progress mode (the control is in the chord progress mode when "1" and is not in the chord progress mode when "0");

(f) A rhythm number register: stores currently selected one of the rhythm numbers;

(g) Part rhythm number registers: are provided for parts of a rhythm data pattern and store the associated rhythm numbers of the parts of the currently selected rhythm data pattern;

(h) Timbre number registers: are provided for parts other than a drum part and store timbre numbers of the parts of the currently selected rhythm data pattern;

(i) A tempo register: stores a tempo data indicative of currently selected tempo;

(j) Automatic accompaniment address registers: are provided for the parts of the currently selected rhythm data pattern, and store storage addresses of note data for the parts which are currently used for sound generation;

(k) Automatic accompaniment step time registers: are provided for the parts of the currently selected rhythm data pattern, and store step times of note data for parts which are currently used for sound generation;

(1) A rhythm counter COUNT: is a counter which is counted up for every time period determined in accordance with the tempo data, and is used to detect sound generation timings for the parts;

(m) An edit part register: is a register which stores a data indicative of which one of the parts is currently edited;

(n) A chord name register: stores a chord name of a current chord change instruction data of a chord progress data;

(o) A chord progress address register: stores a storage address of a current chord change instruction data of a chord progress data;

(p) A chord progress step time register: is a register which stores a step time STEP to control chord progress in automatic accompaniment; and (q) A chord progress counter CBCNT: is a counter which is counted up for every time period determined in accordance with the tempo data, and is used to detect a timing for the chord to be changed.

Figure 2:
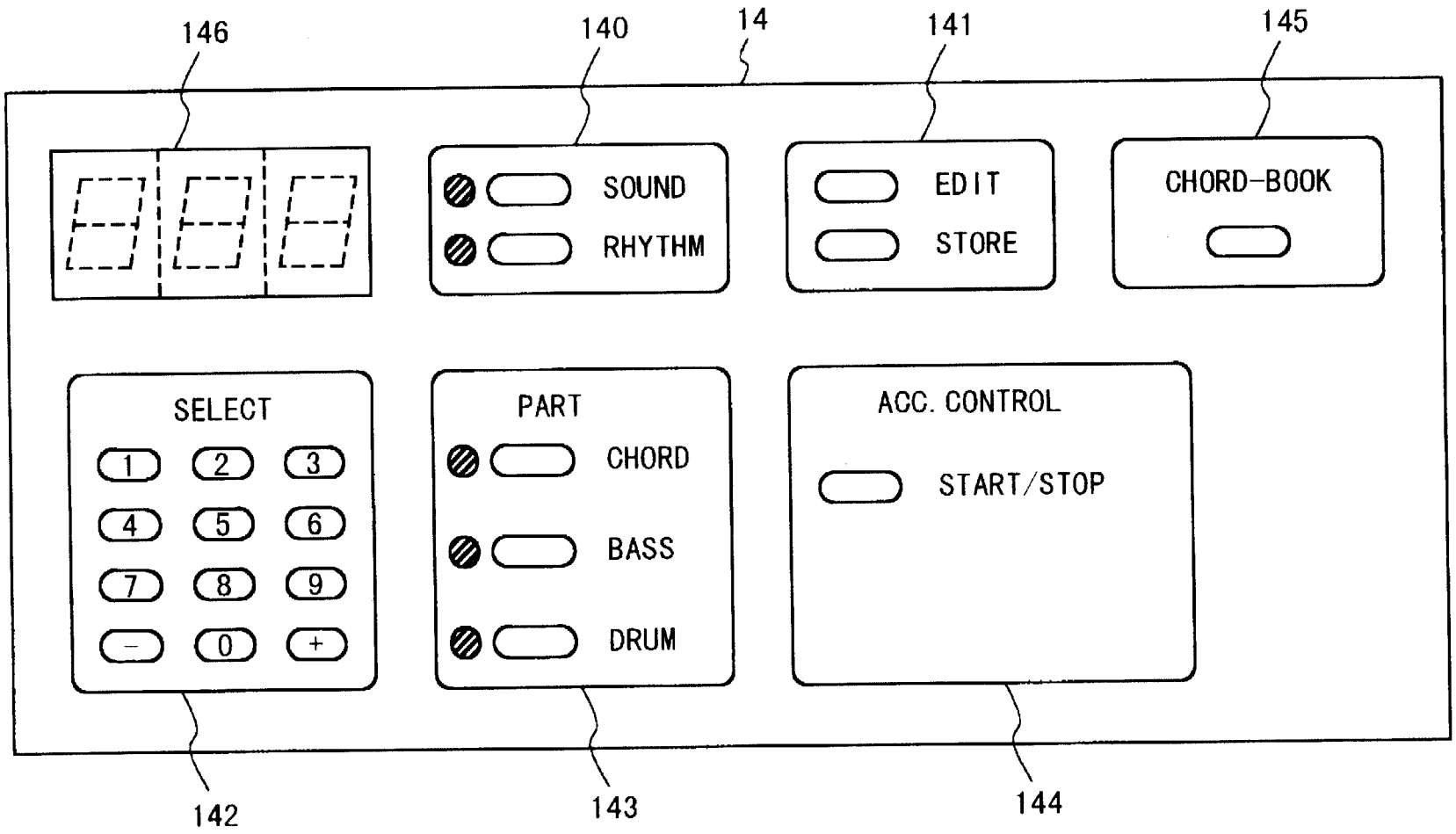
FIG. 2 is a diagram showing the arrangement of various switches and display on an operation panel in the electronic musical instrument of FIG. 1.

Next, the structure of the operation panel 14 which is used in the embodiment will be described in detail with reference to FIG. 2. Note that only the parts which are necessary for the explanation of the present invention are shown in FIG. 2, but various switches, displays and indicators and so on are provided in the actual electronic musical instrument in addition to the above structure. The operation panel 14 is composed of six switch blocks 140 to 145 and a display 146.

The switch block 140 includes a sound switch SOUND and a rhythm switch RHYTHM. Indicators which are shown by a circle with slanted lines in the figure, are provided for these two switches. For example, both switches may be push button switches. The sound switch SOUND is used to move the control into a timbre selection mode. The rhythm switch RHYTHM is used to move the control into a rhythm selection mode. These switches are both controlled such that only one is effective at the same time. Which mode is active at present is shown by indicators, and at the same time is stored in the sound flag SNDFLG.

The switch block 141 is composed of an edit switch EDIT and a storage switch STORE. Also, indicators are provided for these switches. Both switches may be push button switches. The edit switch EDIT is used to move the control to the edit mode. Whether the current mode is the edit mode is stored in the edit flag EDTFLG. In the state which the edit mode is set through the operation of this edit switch EDIT, the user defining rhythm data pattern can be produced. The storage switch STORE is used to store the user defining rhythm data pattern produced by the user in the data pattern area of the RAM 12.

The switch block 142 is used as a selection switch SELECT. The selection switch SELECT is used to input a numerical value to select a timbre number, a rhythm number or the like. Ten keys ("0" to "9" keys), an increment key ("+" key) and a decrement key ("–" key) are contained in the switch block 142. The ten keys are used to input a numerical value. The numerical value inputted from the ten keys is displayed on the display 146. Also, the increment key is used to increment the value currently displayed on the display 146 and the decrement key is used to decrement the value currently displayed on the display 146. For example, each of these keys may be a push button switch.

The switch block 143 is used as a part switch PART. The part switch PART is used to select one of parts of a rhythm data pattern. The switch block 143 is composed of a chord switch CHORD, bass switch BASS and drum switch DRUM, for which indicators are respectively provided. For example, each of these switches may be a push button switch. The chord switch CHORD, bass switch BASS and drum switch DRUM are used to select the chord part, bass part and drum part, respectively. Only one of these switches is effective at the same time. Which part is selected at present is indicated by indicators, and, at the same time, is stored in the edit part register. If the above-mentioned second example of rhythm data pattern is used, "9" part switches are provided for all the parts of the rhythm data pattern in the switch block 143.

The switch block 144 is composed of an accompaniment control switch ACC.CONTROL. The accompaniment control switch ACC.CONTROL is used to control an automatic accompaniment. For example, the start/stop switch START/STOP may be a push button switch. The start/stop switch START/STOP is used to start or to stop the automatic accom~animent. More particularly, the automatic accompaniment is started in the electronic musical instrument when the start/stop switch START/STOP is pushed in the state in which the automatic accompaniment is suspended. On the other hand, the automatic accompaniment is stopped in the electronic musical instrument when the start/stop switch START/STOP is pushed in the state in which the automatic accompaniment is performed. Whether the automatic accompaniment is being performed or suspended at present is stored in a rhythm flag RYMFLG Note that an introduce switch, fill-in switch, ending switch and so on are also provided in addition to the accompaniment control switch ACC.CONTROL other than the above-mentioned switch but the illustration of these switches is omitted.

The switch block 145 includes a chord progress instruction switch CHORD-BOOK. The chord progress instruction switch CHORD-BOOK is used to move the control to a chord progress mode. Here, the chord progress mode means the mode to make the automatic accompaniment progress while developing the chord in accordance with a chord progress data. Whether or not the current mode is the chord progress mode is stored in a chord progress instruction flag CBFLG.

The display 146 is composed of 7-segment LEDs for 3 digits. For example, a timbre number is displayed on the display 146 in the timbre selection mode, and a rhythm number is displayed in the rhythm selection mode. Further, other various types of information are displayed on the display 146. Note that the display is not limited to 7-segment LEDs, and various displays can be used such as an LCD display, CRT display, and display which can display a numeral value and characters.

The operation panel 14 is connected to the panel interface circuit 13. The panel interface circuit 13 controls transmission/reception of data between the operation panel 14 and the CPU 10. The transmission/reception of data is performed in the following procedure. That is, the panel interface circuit 13 sends out a scan signal to the operation panel 14 in response to an instruction from the CPU 10. The operation panel 14 sends back a signal indicative of the ON/OFF state of each of the switches to the panel interface circuit 13 in response to the scan signal. The panel interface circuit 13 generates panel data based on the signal received from the operation panel 14. The panel data is composed of a sequence of bits each of which indicates the ON/OFF state of each switch. The panel data generated by the panel interface circuit 13 is sent to the CPU 10. Also, the panel interface circuit 13 sends display data received from the CPU 10 to the operation panel 14. Thus, the ON/OFF states of the indicators on operation panel 14 are controlled.

The wave form memory 18 stores wave form data. The wave form memory 18 is composed of, for example, a read only memory (ROM). A plurality of wave form data corresponding to a plurality of timbre parameters are stored in the wave form memory 18. Each of the plurality of wave form data can be generated by converting a generated musical instrument sound into an electric signal, and then by performing pulse code modulation (PCM) to the electric signal. The wave form memory 18 is accessed by the music sound generating unit 19 through the system bus 30.

The music sound generating unit 19 has a plurality of sound generation channels. The music sound generating unit 19 generates a musical sound signal in accordance with the timbre parameters, using the sound generation channels specified by the CPU 10. That is, when receiving the designation of the sound generation channels and the timbre parameter from the CPU 10, the music sound generating unit 19 reads the wave form data from the wave form memory 18 using the functions of the designated sound generation channels, and adds envelopes to the wave form data to generate a digital musical sound signal. The digital musical sound signal is supplied to the D/A converter 20.

The D/A converter 20 converts the digital musical sound signal from the music sound generating unit 19 into an analog musical sound signal to send to the amplifier 21. The amplifier 21 amplifies the inputted analog musical sound signal with a predetermined gain to send to the speaker 22. The speaker 22 converts the analog musical sound signal from the amplifier 21 into the sound signal to output it. In this manner, the musical sound is generated from the speaker 22.

Next, the operation of the electronic musical instrument to which the automatic accompaniment apparatus according to the embodiment of the present invention is applied will be described below in detail with reference to the flow charts shown in FIGS. 9 to 14. The processes shown in the following flow charts are all performed by the CPU 10.

(1) MAIN PROCESS

Figure 9:
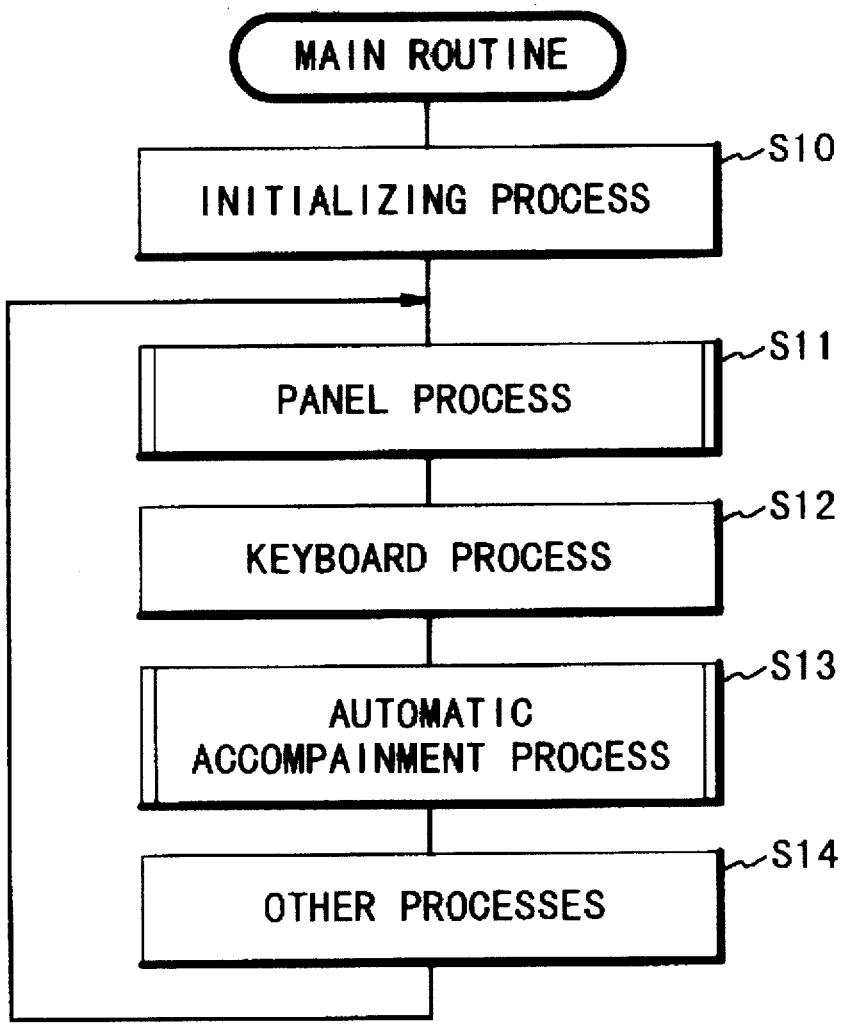
FIG. 9 is a flow chart showing a main processing routine in the automatic accompaniment apparatus according to the embodiment of the present invention.

FIG. 9 is a flow chart which shows the main processing routine of the electronic musical instrument to which the automatic accompaniment apparatus according to the embodiment of the present invention is applied. The main processing routine is started when a power supply is turned on. More particularly, when the power supply is turned on, an initialization process is performed (step S10).

In the initialization process, the internal state of the CPU 10 is set to the initial state. At the same time, buffers, registers, counters, flags and so on which are all defined in the RAM 12 are set to the initial states. Also, predetermined data is sent to the music sound generating unit 19 during the initialization process, the processing is performed to prevent any unnecessary sound being generated when the power is turned on. Further, the definition initial data is set in predetermined registers of the RAM 12.

Next, when the initialization process is ended, a panel process is performed (step S11). In the panel process, the processing which responds to the operation of a switch on operation panel 14 and the process to display the data on the display are performed. The details of the panel process are mentioned later.

Next, when the above panel process ends, a keyboard process is performed (step S12). In this keyboard process, a sound generation process is performed in response to a key push event and a sound extinguishment process is performed in response to a key release event. To describe more particularly, in the keyboard process, the presence or non-presence of a key event is first determined. That is, the CPU 10 reads a key data from the keyboard interface circuit 15 (hereinafter, it is referred to as a "new key data"). Exclusive OR logic summation is calculated between the new key data and a key data which has been read out in the previous keyboard process and has been stored in the RAM 12 (hereinafter, it is referred to as an "old key data"). Then, a key event map is produced based on the exclusive OR logic summation result. If there is any "ON" bit in the key event map thus produced, it is determined that a key event is generated. When it is determined that there is any key event by referring to the key event map, whether or not the key event is a key push event is checked. This is performed by checking whether or not the bit in the new key data which corresponds to the "ON" bit in the key event map is in the "ON" state. The sound generation process is performed when it is determined that the key push event is generated.

In the sound generation process, the sound generation is allocated to a sound generation channel in music sound generating unit 19. Then, the timbre parameter is read from the program memory 11 based on the key number of the key corresponding to the key push event and the timbre which is selected at that time. The timbre parameter and the touch data which is supplied from the keyboard interface circuit 15 5 are sent to the music sound generating unit 19. In this manner, the digital musical sound signal is generated by the allocated sound generation channel of the music sound generating unit 19 based on the above timbre parameter and the touch data. The digital musical sound signal is sent through the D/A converter 20 and the amplifier 21 to the speaker 22, so that the sound generation is performed.

On the other hand, when it is determined that the key event is not the key push event–but the key release event, the sound extinguishment process is performed. In the sound extinguishment process, the sound generation channel which is allocated to the key corresponding to the key release event is searched in the music sound generating unit 19. A predetermined data is sent to the searched sound generation channel to complete the sound extinguishment process.

When the above-mentioned sound generation or sound extinguishment process is ended, the new key data is stored in the RAM 12 as the old key data and the keyboard process is ended.

Next, when above keyboard process is ended, the automatic accompaniment process routine is executed in the main process routine (step s13). In this automatic accompaniment process, a rhythm data pattern is read from the pattern memory 17 or RAM 12 based on the specified rhythm number and then the sound generation is started. The detail of the automatic accompaniment process will be described later.

Next, when the automatic accompaniment process is ended, "other processes" are performed (step S14). In the "other processes", a process to send and receive MIDI data between the automatic accompaniment apparatus and an external apparatus through an MIDI interface circuit (not shown) is included.

Thereafter, the control returns to the step S11 and the same processes are repeated hereinafter. When any event is generated based on the panel operation or the keyboard operation during repetitive execution of the processes of the above step S11 to S14 in the main process routine, the processing corresponding to the generated event is performed so that various functions such as the automatic accompaniment function of the electronic musical instrument and so on are realized.

(2) PANEL PROCESS

Figure 10A:
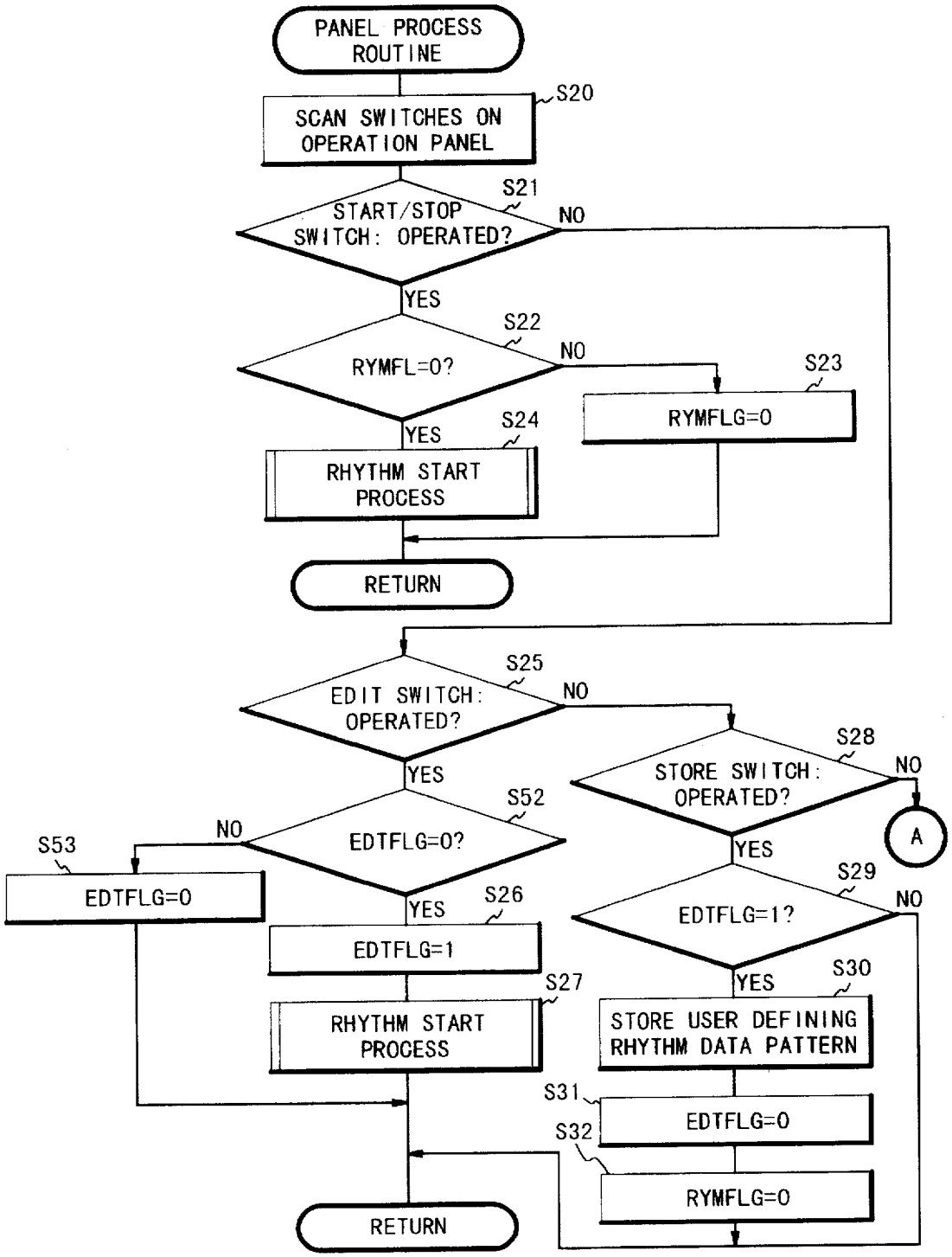
FIGS. 10A to 10C are flow charts showing a panel processing routine in the automatic accompaniment apparatus according to the embodiment of the present invention.
Figure 10B:
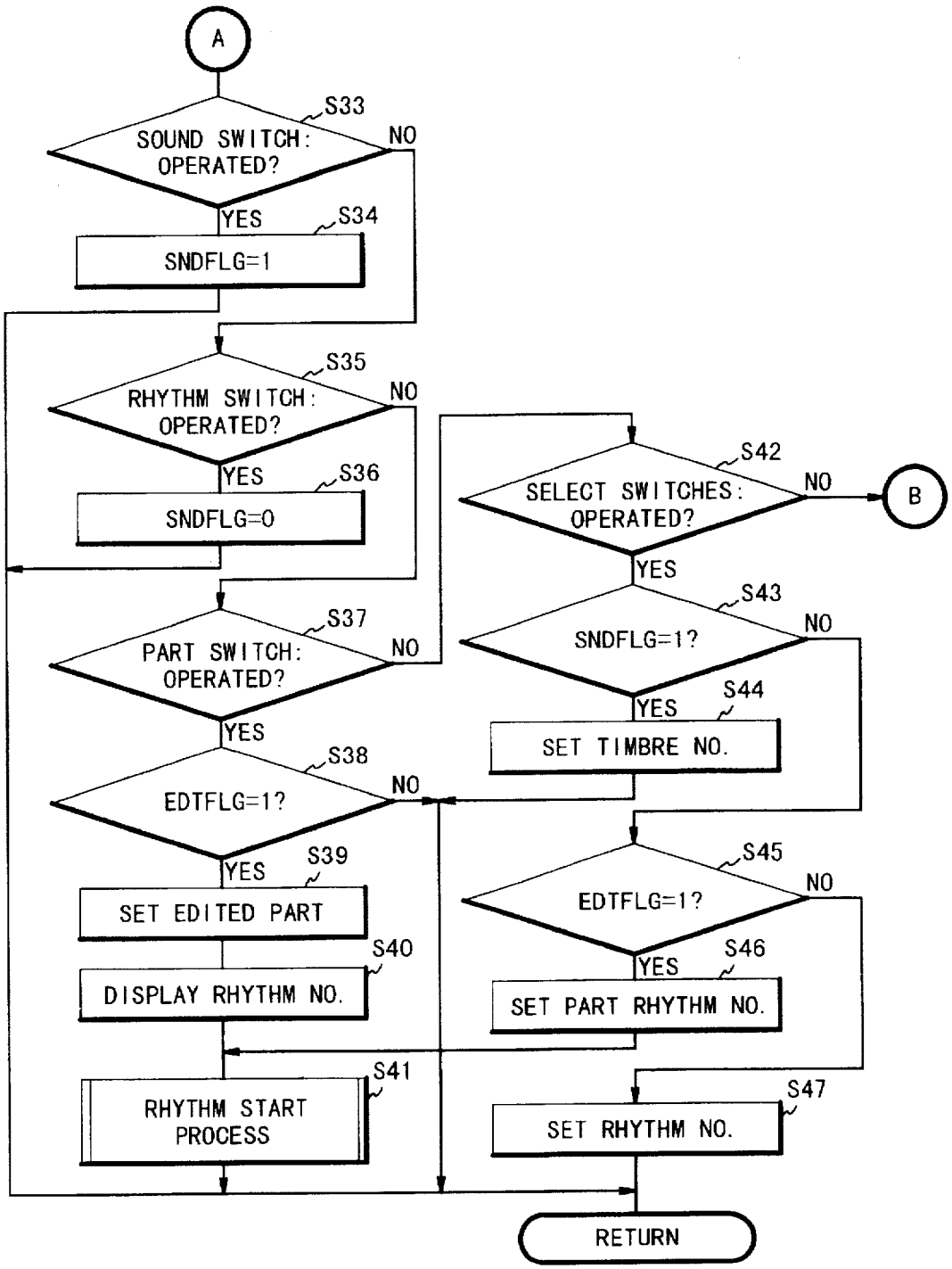
Figure 10C:
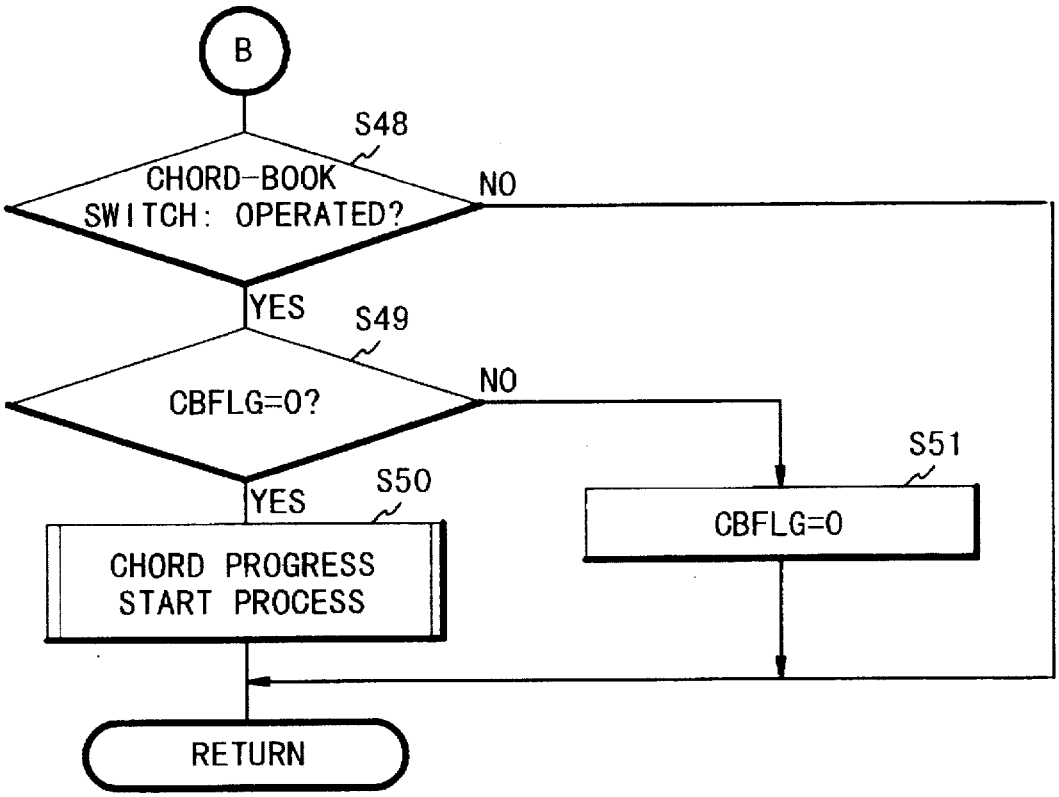

Next, the panel process will be described below in detail with reference to the flow charts of FIGS. 10A to 10C.

In the panel process, first, a panel scan is performed (step S20). In the panel scan, the CPU 10 sends a panel scan instruction to the panel interface circuit 13. The panel interface circuit 13 scans the operation panel 14 in response to the panel scan instruction. Then, the panel interface circuit 13 reads a panel data indicative of the on or off state of each of the switches on the operation panel 14 (hereinafter, to be referred to as a "new panel data") and sends the new panel data to the CPU 10. The CPU 10 performs the exclusive-0R logic summation between the new panel data and the panel data which has been read from the operation panel 14 in the previous panel process and has been stored in the RAM 12 (hereinafter, to be referred to as an "old panel data"), and produces a panel event map. The CPU 10 detects a switch event from the panel event map. Thereafter, the new panel data is stored in the RAM 12 as the old panel data.

Next, whether the ON event of the start/stop switch START/STOP is generated is checked (step S21). This is performed by checking whether the bits corresponding to the start/stop switch START/STOP are both in the ON state in the above panel event map and the new panel data. When it is determined that the ON event of the start/stop switch START/STOP is generated, whether or not the rhythm flag RYMFLG is "0" is checked (step s22). When it is determined that the rhythm flag RYMFLG is "1", it is determined that the start/stop switch START/STOP is pushed during the automatic accompaniment. As a result, the rhythm flag RYMFLG is reset to "0" (.step s23). Thereafter, the control returns from the panel process routine to the main process routine. In this manner, the automatic accompaniment is stopped when the start/stop switch START/STOP is pushed during the automatic accompaniment.

On the other hand, when it is determined that the rhythm flag RYMFLG is "0" in the above step S22, it is determined that the start/stop switch START/STOP is pushed when the automatic accompaniment is suspended. As a result, the rhythm start process is performed (step S24). That is, the data required to perform automatic accompaniment in accordance with the rhythm specified by a system defining rhythm data pattern or a user defining rhythm data pattern which is designated at that time point is set in work registers of the RAM 12. Note that setting of the rhythm flag RYMFLG is performed during the rhythm start process. The rhythm start process will be described later in detail. Thereafter, the control returns from the panels-process routine to the main process routine.

When it is determined in the above step S21 that no ON event of the start/stop switch START/STOP has been generated, whether or not the ON event of the edit switch EDIT is generated is checked (step S25). This is performed by checking whether the bits corresponding to the edit switch EDIT are both in the ON state in the panel event map and the new panel data. When it is determined that the ON event of the edit switch EDIT is generated, whether or not the edit flag EDTFLG is "0" is checked (step S52). If the edit flag is "1", the edit flag EDTFLG is reset to "0" in a step S53. That is, the edit mode is canceled.

When it is determined in the step S52 that the edit flag EDTFLG is "0", a step S26 is executed where the edit flag EDTFLG is set to "1". As a result, the electronic musical instrument moves to the edit mode. Subsequently, the rhythm start process is performed (step s27). Thus, the automatic accompaniment is prepared in accordance with the system defining rhythm data pattern with the rhythm number set in the initializing process, e.g., with the rhythm number of "0", using the timbre and the tempo which has been set before the edit switch EDIT is pushed. In this manner, the user can start the edit operation after confirming the accompaniment sound which is to be edited in the automatic accompaniment process. The rhythm start process will be described later in detail. Thereafter, the control returns from the panel process routine to the main process routine.

When it is determined in the above step S25 that the ON event of the edit switch EDIT is not generated, whether or not the ON event of the storage switch STORE is generated is next checked (step s28). This is performed by checking whether the bits corresponding to the storage switch STORE are both in the on state in the above panel event map and the new panel data. When it is determined that the ON event of the storage switch STORE is generated, whether or not the edit flag EDTFLG is "1" is checked (step S29). When it is determined that the edit flag EDTFLG is "0", it is determined that the storage switch STORE is pushed when the edit mode is not set. As a result, the control returns from the panel process routine to the main process routine. That is, even if the storage switch STORE is pushed when the edit mode is not set, the key operation is ignored.

On the other hand, when it is determined that the edit flag EDTFLG is "1", the currently set user defining rhythm data pattern is stored (step s30). In the automatic accompaniment apparatus to which the user defining rhythm data pattern shown in the first example of FIG. 5 is applied, the rhythm number allocated to the system defining rhythm data pattern for each of the chord part, bass part and drum part, and user definition initial data such as chord timbre number, bass timbre number and tempo data, which are all designated when the storage switch STORE is pushed, are stored in the corresponding areas of a data pattern area of the RAM 12. That is, the rhythm numbers for the chordspart, bass part and drum part are stored in the part rhythm number registers of the pattern data area, and the chord and bass timbre numbers and tempo data are stored in the timbre number registers and the tempo register.

Alternatively, in the automatic accompaniment apparatus to which the user defining rhythm data pattern shown in the second example of FIG. 7 is applied, the user defining rhythm data pattern is stored in the data pattern area of the RAM 12. More particularly, the rhythm numbers of the system defining rhythm data patterns designated when the storage switch STORE is pushed are stored in predetermined areas of the data pattern area corresponding to the chord 1, chord 2, chord 3, bass, bass drum, snare drum, hi-hat, sub-drum 1 and sub-drum 2. Also, the timbre numbers of the chord 1 to the chord 3, the bass timbre number and the tempo data of the user definition initial data are stored in the timbre number registers and the tempo register in the data pattern area of the RAM 12.

Next, the edit flag EDTFLG is reset to "0" (step S31). Also, the rhythm flag RYMFLG is reset to "0" (step S32).

Thus, the edit mode is ended and the control enters the usual mode. At the same time, the automatic accompaniment is stopped in the automatic accompaniment process. Thereafter, the control returns from the panel process routine to the main process routine.

When it is determined in the above step S28 that the ON event of the storage switch STORE is not generated, whether or not the ON event of the sound switch SOUND is generated is next checked (step S33). This is performed by checking whether the bits corresponding to the sound switch SOUND are in the ON state in the above panel event map and the new panel data. When it is determined that there is generated the ON event of the sound switch SOUND, the sound flag SNDFLG is set in "1" (step S34). Subsequently, the control returns from the panel process routine to the main process routine. Thus, the electronic musical instrument enters the timbre selection mode.

When it is determined in the above step S33 that the ON event of the sound switch SOUND is not generated, whether or not the ON event of the rhythm switch RHYTHM is generated is next checked (step S35). This is performed by checking whether the bits corresponding to the rhythm switch RHYTHM are both set in the ON state in the above panel event map and the new panel data. When it is determined that the ON event of the rhythm switch RHYTHM is generated, the sound flag SNDFLG is reset to "0" (step s36). Subsequently, the control returns from the panel process routine to the main process routine. Thus, the electronic musical instrument enters the rhythm selection mode.

When it is determined in the above step S35 that the ON event of the rhythm switch RHYTHM is not generated, whether or not the ON event of the part switch PART is generated is next checked (step S37). This is performed by checking whether or not the bits corresponding-to any one of the chord switch CHORD, the bass switch BASS or the drum switch DRUM are both set in the ON state in the event map and the new panel data. When it is determined that the ON event of the part switch PART is generated, whether or not the edit flag EDTFLG is "1" is next checked (step s38). When it is determined that the edit flag EDTFLG is "0", it is determined that the part switch PART is pushed when the edit mode is set. As a result, the control returns from the panel processing routine to the main processing routine. That is, even if the part switch PART is pushed when the edit mode is not set, the switch operation is ignored.

On the other hand, when it is determined that the edit flag EDTFLG is "1", one of the chord part, bass part or drum part corresponding to the pushed switch is selected (step S39). Next, the rhythm number which is set at present for the selected part is read out and displayed on the display 146 (step S40). Subsequently, the rhythm start process is performed (step S41). Thus, the data required to perform the automatic accompaniment are set and the automatic accompaniment is performed in the automatic accompaniment process. The selected rhythm number can be changed into an arbitrarily selected number using the rhythm switch RHYTHM and the selection switch SELECT. The rhythm start process will be described later in detail. Thereafter, the control returns from the panel process routine to the main process routine.

When it is determined' in the above step S37 that the ON event of the part switch PART is not generated, whether or not the ON event of the selection switch SELECT is generated is next checked (step s42). This is carried out by checking whether or not the bits corresponding to one of the ten keys (0–9), the increment key (+) or the decrement key (–) are both set in the ON state in the event map and the new panel data. When it is determined that the ON event of the selection switch SELECT is generated, whether or not the sound flag SNDFLG is "1" is next checked (step S43). When it is determined that the sound flag SNDFLG is "1", it is determined that the tone selection mode is set and the setting of the timbre number is performed (step S44). That is, the timbre number which is selected by the selection switch SELECT is stored in the timbre number register of the RAM 12 which corresponds to the part number set at that time point. Thereafter, the control returns from the panel process routine to the main process routine. In this manner, the automatic accompaniment of the selected part is performed with the timbre which corresponds to the timbre number which is set to the timbre number register.

When it is determined in the above step S43 that the sound flag SNDFLG is "0", it is determined that the current mode is the rhythm selection mode. Next, whether or not the edit flag EDTFLG is "1" is checked (step S45). When it is determined that the edit flag EDTFLG is "1", it is determined that the current mode is the edit mode, and the part rhythm number is set (step S46). That is, the part rhythm number which is selected by the selection switch SELECT is stored in the part rhythm-number register of the RAM 12 which corresponds to the part number which is set at that time point. At the same time, a chord progress data number associated with the selected part is also stored. Next, the rhythm start process is performed (step S41). The automatic accompaniment of the selected part is performed with the rhythm which corresponds to the rhythm number which is set to the part rhythm number register, in accordance with the set chord Progress data.

On the other hand, when it is determined that the edit flag EDTFLG is not "1", the rhythm number of the system defining rhythm data pattern or the user defining rhythm data pattern is set (step S47). That is, the number which has been set with the selection switch SELECT is stored in the rhythm number register. Through the above processes, the rhythm number which is allocated for the selected part is selected in the edit mode, and the rhythm number of the system defining rhythm data pattern or the user defining rhythm data pattern to be automatically accompanied is selected when the edit mode is not set. Thereafter, the control returns from the panel process routine to the main process routine.

When it is determined in the above step S42 that the ON event of the selection switch SELECT is not generated, whether or not the ON event of the chord progress instruction switch CHORD-BOOK is generated is next checked (step S48). This is performed by checking whether the bits corresponding to the chord progress instruction switch CHORD-BOOK are both set in the ON state in the panel event map and the new panel data. When it is determined that the ON event of the chord progress instruction switch CHORD-BOOK is generated, whether or not the chord progress instruction flag CBFLG is "0" is next checked (step s49). When it is determined that the chord progress instruction flag CBFLG is "1", it is determined that the chord progress instruction switch CHORD-BOOK is pushed in a chord progress mode. The chord progress instruction flag CBFLG is reset to "0" (step S51). Thereafter, the control returns from the panel process routine to the main process routine. In this manner, when the chord progress instruction switch CHORD-BOOK is pushed in the chord progress mode, the mode moved to the usual mode.

On the other hand, when it is determined that the chord progress instruction flag CBFLG is "0", it is determined that the chord progress instruction switch CHORD-BOOK is pushed when the chord progress mode is not set, and the chord progress start process is performed (step S50). In this manner, thereafter, the automatic accompaniment progresses in accordance with the chord progress data. The chord progress start process will be described below in detail. Thereafter, the control returns from the panel process routine to the main process routine. Note that when it is determined in the above step S48 that the ON event of the chord progress instruction switch CHORD-BOQK is not generated, it is determined that the ON event of all the switches is not generated and the control returns from the panel process routine to the main process routine.

Figure 11:
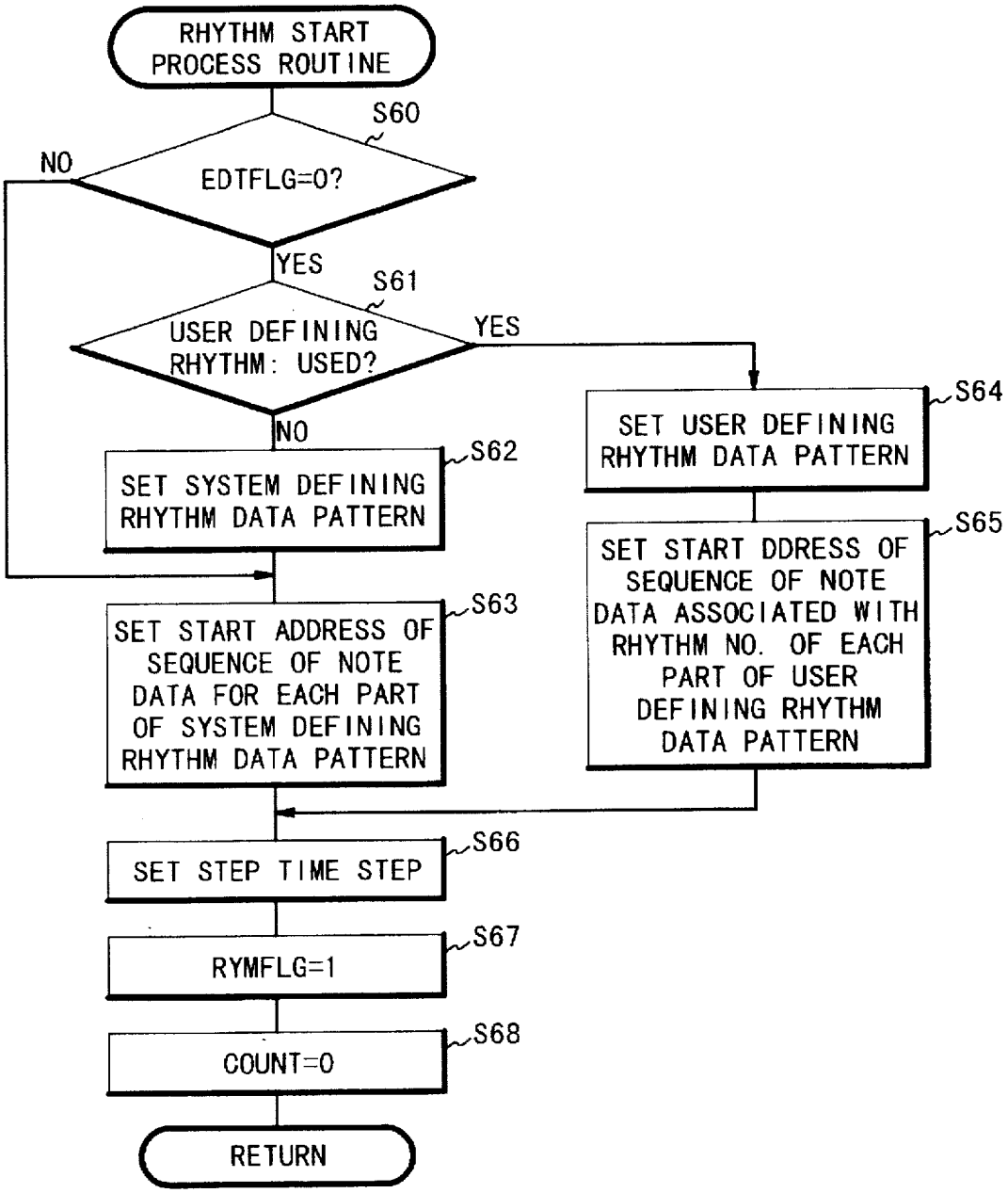
FIG. 11 is a flow chart showing a rhythm start processing routine in the automatic accompaniment apparatus according to the embodiment of the present invention.

Next, the rhythm start process will be described below in detail with reference to the flow chart shown in FIG. 11. In the rhythm start process, whether or not the edit flag EDTFLG is "0" is first checked (step s60). When it is determined that the edit flag EDTFLG is "0", i.e., the edit maode is not set, whether or not the current rhythm number is a rhythm number which specifies one of the user defining rhythm data patterns is checked (step s61). This is performed by checking whether or not the content of the rhythm number register are equal to or more than "100". When it is determined that the rhythm number does not designate the user defining rhythm data pattern, the system definition initial data is read out based on the content of the rhythm number register and is set in the timbre number registers and the tempo register (step S62). These may be set in the initialization process or the timbre and the tempo may be left over from when automatic accompaniment was previously performed. Thus, the timbre and the tempo are determined when sound generation is performed based on the system defining rhythm. Subsequently, the address at the head of the sequence of note data which corresponds to each part of the current system defining rhythm data pattern is set in the automatic accompaniment address register (step S63). In this manner, the reading start position of the note data from the pattern memory 17 is determined.

When it is determined in the above step S61 that the user defining rhythm is set then step S64 is performed. That is, the user defining rhythm data pattern which corresponds to the rhythm number set in the rhythm number register is read out from the data pattern area of the RAM 12 and is set in the part rhythm number register, the timbre number registers, and the tempo register. In this manner, the timbres and the tempo are determined when the sound generation is performed based on the user defining rhythm. Next, the address at the head of the sequence of note data which is specified using the system defining rhythm data pattern for the associated rhythm number of each part in the user defining rhythm data pattern which corresponds to the current rhythm number is set in the automatic accompaniment address register (step s65). Thus, the reading start position of the note data in pattern memory 17 is determined. Thereafter, the control advances to the step S66.

When it is determined in the above step S60 that the edit flag EDTFLG is "1", i.e., the edit mode, the control branches to the step S63. This is the processing when the control has entered the edit mode by the user pushing the edit switch EDIT. In this case, the system defining rhythm data pattern is not set, but there is used the user defining rhythm data pattern designated based on the data already stored in the part rhythm number registers, the timber number registers and the tempo register. The addressset at the head of the sequence of note data for each part of the rhythm data pattern is set (step S63). This means that if the rhythm number is selected and the edit switch EDIT is pushed, the automatic accompaniment is started using the timbres and tempo set at that time point. Therefore, if the user sets the desired timbres and tempo, when the rhythm number is thereafter selected and then the edit switch EDIT is pushed, the automatic accompaniment can be started using the desired timbres and tempo.

The step time STEP of the note data at the head of each part is set in the step S66. That is, one of the note data of the sequence is read from the storage position of the pattern memory 17 which is specified by each automatic accompaniment address register, and the step time STEP contained in the read note data is set in the corresponding automatic accompaniment step time register.

Next, the rhythm flag RYMFLG is set in "1" (step S67). Thus, it is indicated that the automatic accompaniment is being performed. Subsequently, the rhythm counter COUNT is reset to the zero (step S68). Thereafter, the content of This rhythm counter COUNT is incremented every time the read timing comes during the automatic accompaniment process routine to be mentioned later. Thereafter, the control returns from the rhythm start process routine. Thereafter, in the automatic accompaniment process routine to be mentioned later, the automatic accompaniment progresses while the contents of the above automatic accompaniment address registers are sequentially updated.

Figure 12:
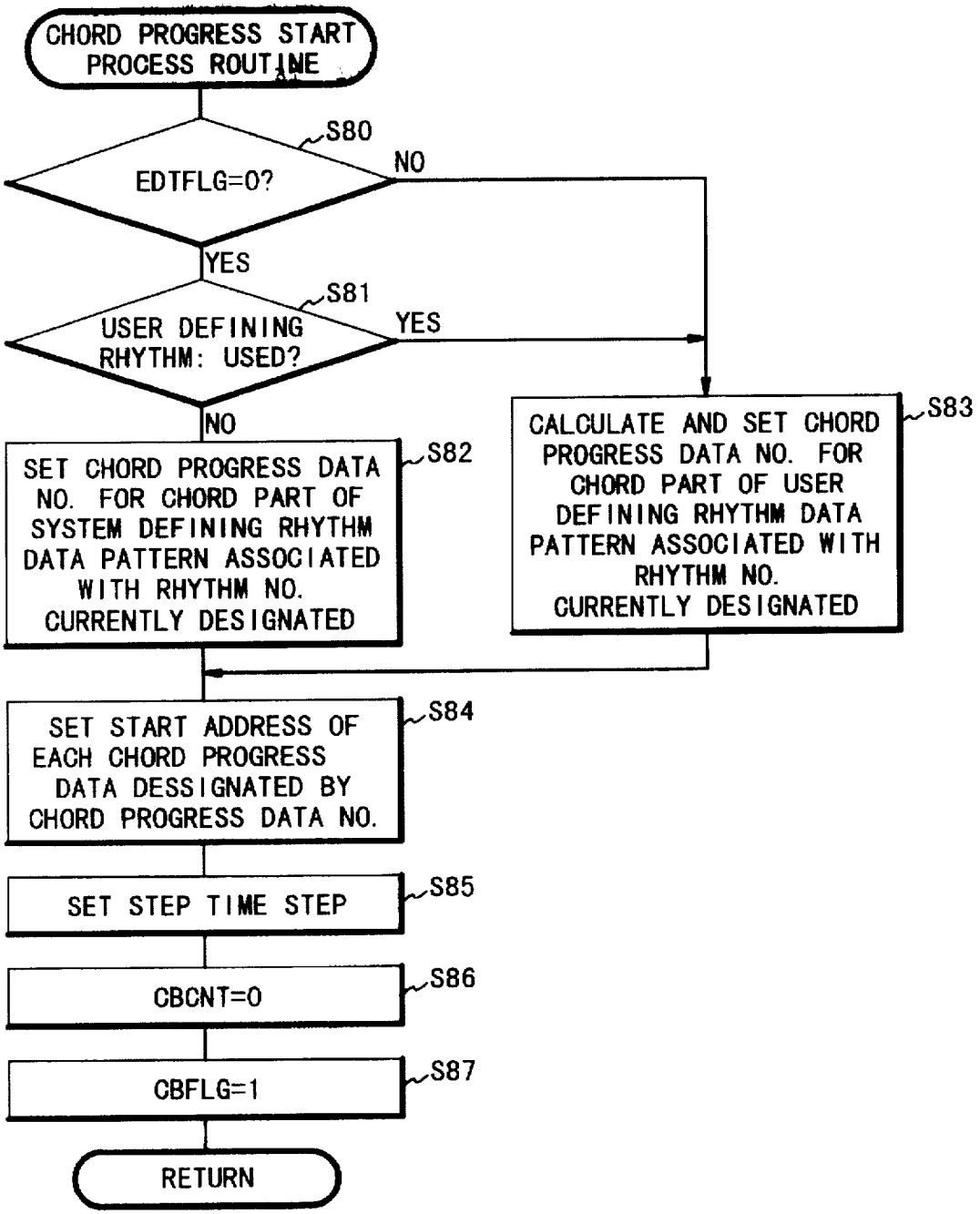
FIG. 12 is a flow chart showing a chord progression start processing routine in the automatic accompaniment apparatus according to the embodiment of the present invention.

Next, the chord progress start process will be described below in detail with reference to the flow chart shown in FIG. 12. In the chord progress start process, whether or not the edit flag EDTFLG is "0" is first checked (step S80). When it is determined that the edit flag EDTFLG is "0", i.e., the edit mode is not set, whether or not the current rhythm number is the rhythm number to designate the user defining rhythm data pattern is next checked (step S81). This is performed by checking whether or not the content of the rhythm number register is equal to or more than "100". When it is determined that the user defining rhythm is not designated, the chord progress data number for the chord part of the system defining rhythm number is stored in the perform work register which is prepared in the RAM 12 (step S82).

On the other hand, when it is determined in the above step S80 that the edit flag EDTFLG is "1", i.e., the edit mode is set, or when it is determined in the above step S81 that the user defining rhythm is designated, the user defining rhythm data pattern is read out based on the rhythm number. Then, the chord progress data numbers of the chord part and bass part are read out using the associated rhythm numbers of the read out rhythm data pattern (step S83). In this embodiment., the chord progress data numbers for the chord part and bass part are the same. Thus, the chord progress data number of the chord part is used in the automatic accompaniment apparatus to which the first example of user defining rhythm data pattern shown in FIG. 5 is applied, and the chord progress data number of the chord 1 part is used in the automatic accompaniment apparatus to which the second example of user defining rhythm data pattern shown in FIG. 7 is applied.

Next, the address at the head of the sequence of chord change instruction data designated by the read chord progress data number is set in the chord progress address register (step S84). Thus, the read start position of the sequence of chord change instruction data, i.e., the chord progress data stored in pattern memory 17, is determined.

Next, the step time STEP of the head chord change instruction data is set (step S85). That is, one chord change instruction data is read from the storage position of the pattern memory 17 which is specified by the chord progress address register and the step time STEP which is contained in the read chord change instruction data is set in the chord progress step time register.

Next, the content of the chord progress counter CBCNT is reset to the zero (step S86). Next, the chord progress instruction flag CBFLG is set to "1". Thus, the chord progress mode is set. The content of the chord progress counter CBCNT is incremented every time the read timing comes in the chord progress processing routine to be mentioned later. Thereafter, the control returns from the chord progress start process routine. Thereafter, in the automatic accompaniment process routine described below, the chord is sequentially changed with the progression of the automatic accompaniment while the above chord progress address register is updated.

(3) AUTOMATIC ACCOMPANIMENT PROCESS

Figure 13:
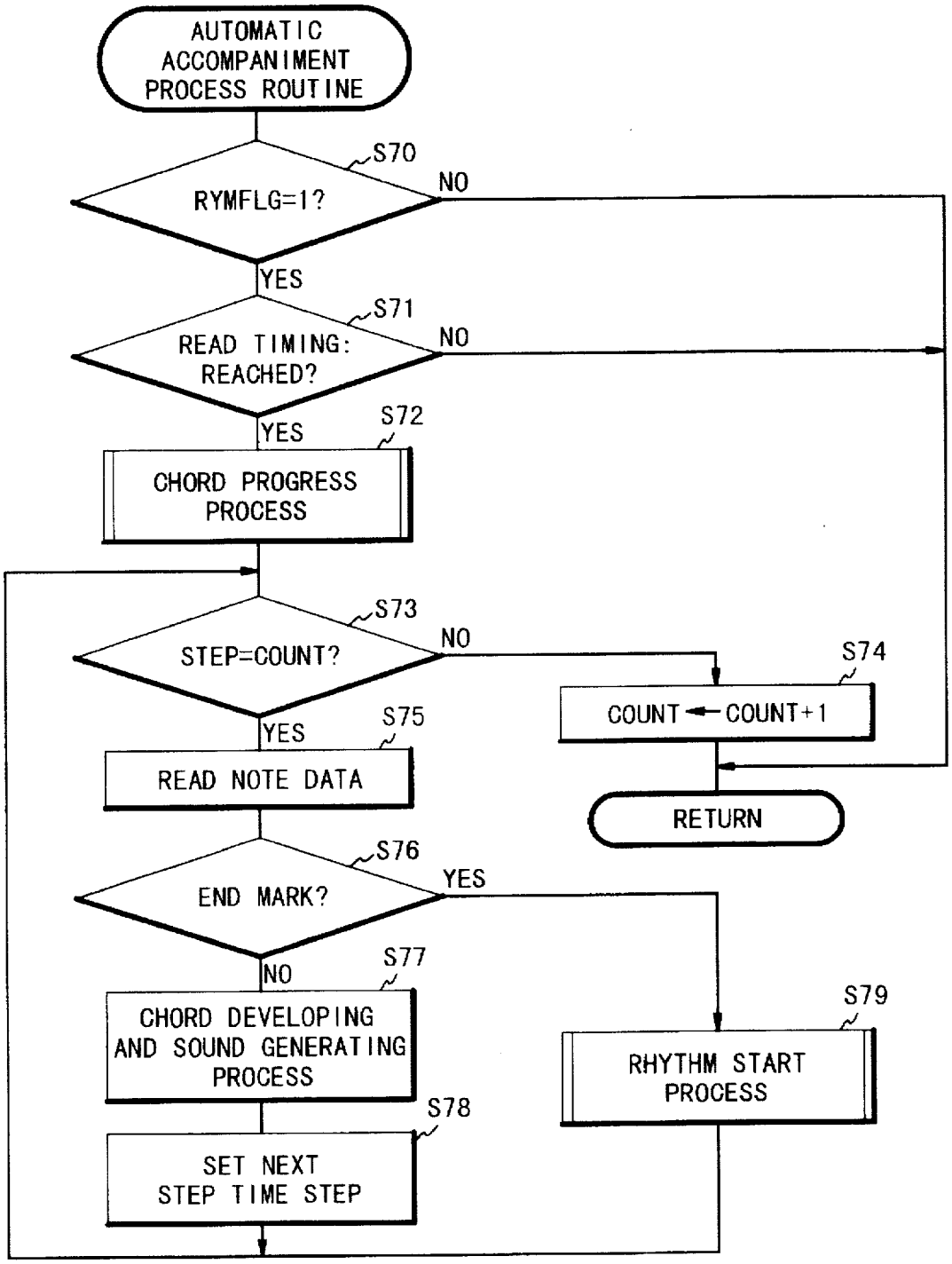
FIG. 13 is a flow chart showing an automatic accompaniment processing routine in the automatic accompaniment apparatus according to the embodiment of the present invention.

Next, the automatic accompaniment process will be described in detail with reference to the flow chart shown in FIG. 13.

In the automatic accompaniment process, whether or not the rhythm flag RYMFLG is "1" is first checked (step S70). When it is determined that the rhythm flag RYMFLG is not set to "1", i.e., the automatic accompaniment is suspended, the control returns from the automatic accompaniment process routine to the main process routine without performing the following process. in this manner, the automatic accompaniment is stopped.

On the other hand, when it is determined that the rhythm flag RYMFLG is "1", i.e., when it is determined that the automatic accompaniment is being performed, whether or not the read timings of the note data has been reached is checked (step S71). Here, the read timing is the timing that the note data should be read and comes at one or more periods in accordance with the tempo. For example, the determination of whether or not the read timing comes is performed by referring to the time which is counted by a clock mechanism (not shown). When it is determined in the step S71 that the read timing has not yet been reached, the control returns from the automatic accompaniment process routine to the main process routine without performing the following process.

When it is determined in the above step S71 that the read timing has been reached, the chord progress process is performed (step S72). In the chord progress process, when the timing which the chord should be changed comes, the processing which determines the chord used for the chord development in the following step S77 is performed.

Figure 14:
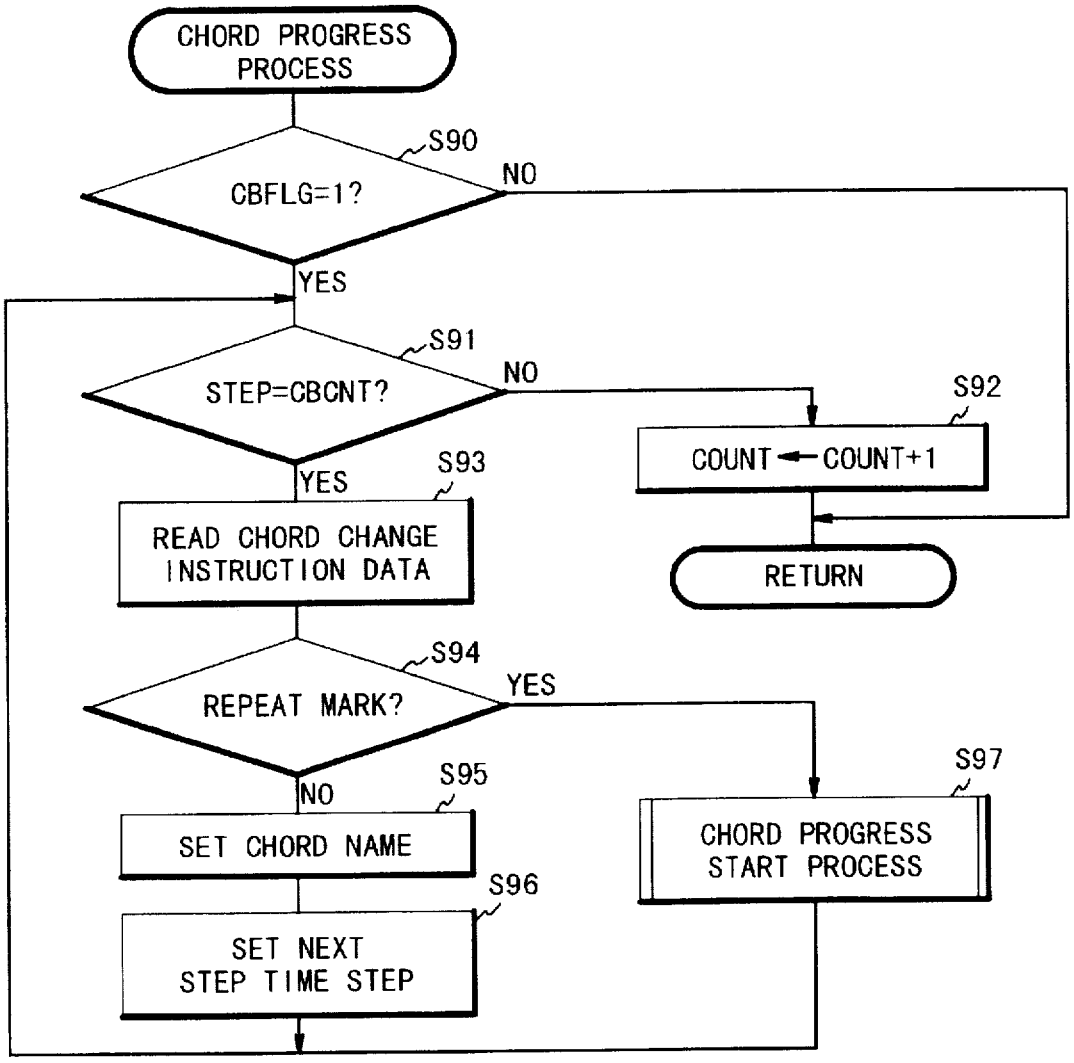
FIG. 14 is a flow chart showing a chord progress processing routine in the automatic accompaniment apparatus according to the embodiment of the present invention.

The chord progress process will be described below in detail with reference to the flow chart shown in FIG. 14. In the chord progress process, whether or not the chord progress instruction flag CBFLG is "1" is first checked (step S90). When it is determined that the chord progress instruction flag CBFLG is not set to "0", i.e., the chord progress mode is not set, the control returns from the chord progress process routine to the automatic accompaniment process routine without performing the following process. In this manner, the chord progress mode is stopped. On the other hand, when it is determined that the chord progress instruction flag CBFLG is "1", i.e., when it is determined that the chord progress mode is set at present, the step time STEP which is set in the step time register for the chord progress and the content of the chord progress counter CBCNT are compared (step S91). When it is determined that they are different not coincident, it is determined that the chord change timing has not yet been reached for the chord progress data, i.e., the chord progress data which has the step time STEP which is set in the chord progress step time register. As a result, the content of the chord progress counter CBCNT is incremented (step S92). Thereafter, the control returns from the chord progress process routine to the automatic accompaniment process routine. Because the chord progress process routine is called from the automatic accompaniment process routine when the read timing has been reached, the increment of the chord progress counter CBCNT is performed at the same time as a read timing.

On the other hand, when it is determined that STEP= CBCNT, the next chord change instruction data (the 2 bytes) is read out from the storage position of the pattern memory 17 which is specified by the address which is set in the chord progress address register at that time point (step S93). Next, whether or not the chord change instruction data indicates the repeat mark is checked (step S94). This is performed by checking the MSB of the first byte of the chord change instruction data. Subsequently, when it is determined that the read chord change instruction data is not the repeat mark, the set of the chord name is performed (step S95). Here, the chord name in the chord change instruction data which is read from the pattern memory 17 is set in the chord name register. As mentioned above, the chord name is used for the chord development in the step S77 of the automatic accompaniment process.

Next, the step time STEP of the next chord change instruction data is read. The step time STEP is set in the chord progress step time register (step S96). Thereafter, the control returns to the step S91 and hereinafter repeats the similar processing. By the above repetitive operations, the chord change instruction data are read one after another for the parts from the pattern memory 17 and the chord change is performed in synchronization with the content of the chord progress counter CBCNT.

On the other hand, when it is determined in the above step S94 that the read chord change instruction data includes the repeat mark, the chord progress start process which should realize the same chord progress once again is performed (step S97). The chord progress start process was already described with reference to FIG. 12. Thereafter, the control returns to the step S91 and the similar process is hereinafter repeated.

When the chord progress process is ended, the step time STEP which is set in the automatic accompaniment step time register, and the content of the rhythm counter COUNT are compared (step S73). When it is determined that they are different then sound generation timing has not yet been reached for the current part, i.e., the note data which have the step time STEP, which is set in the relevant automatic accompaniment step time register. As a result, the content of the rhythm counter COUNT is incremented (step S74). Thereafter, the control returns from the automatic accompaniment process routine the main process routine.

On the other hand, when it is determined that STEP-COUNT, the next note data (the 4 bytes) is read from the storage position of the pattern memory 17 which is specified by the address which is set in the automatic accompaniment address register at that time point (step S75). Subsequently, whether or not the note data indicates the end mark is checked (step S76). This is performed by checking the MSB of the first byte of the note data. When it is determined that the read out note data is not the end mark, the chord development and sound generation process is next performed (step S77). In the chord development process, for example, there is performed the processing to change the chord component sound of a basic chord of C of the note data stored in the pattern memory 17 into a chord component sound determined in accordance with the chord name (stored in the chord name register). For example, when the chord name Em is stored in the chord name register, the sound "E" and "G" are not changed but sound "C" is changed into In the sound generation processing, the sound generation channel in the music sound generating unit 19 is first allocated. Then, the timbre parameter is read from the program memory 11 based on the key number of the note data, velocity and the timbre numbers which indicate the timbres which are selected at that time point; i.e., timbre numbers stored in the timbre number registers. These parameters are sent to the music sound generating unit 19. Thus, in the allocated sound generation channel of the music sound generating unit 19, the digital musical sound signal is generated based on the above timbre parameter, and is sent to the D/A converter 20, the amplifier 21 and the speaker 22 in order and the sound generation is performed. Note that although the sound extinguishment process of the automatic accompaniment sound is not shown, the sound extinguishment process is realized by searching the music sound generating unit 19 for the sound generation channel in which the gate time is "0" and by sending a predetermined data to the searched sound generation channel.

Next, the step time STEP of the next note data is read and is set in the automatic accompaniment step time register (step S78). Subsequently, the control returns to the step S73 and hereinafter repeats the similar processes for the other parts. By the repetitive operation, the note data are read one after another from the pattern memory 17 and the sound generation is performed in synchronization with the content of the rhythm counter COUNT, resulting in performance of the automatic accompaniment.

On the other hand, when it is determined in the above step S76 that the read note data is the end mark, the rhythm start process is performed such that the automatic accompaniment is repeatedly performed (step S79). The rhythm start process was already described with reference to FIG. 11. Thereafter, the control returns to the step S73 and the similar process is hereinafter repeated.

In the automatic accompaniment apparatus of the present invention, a rhythm number of one of the plurality of system defining-rhythm data patterns is independently and arbitrarily related to each of a plurality of parts of the user defining rhythm data pattern. For this purpose, a table which has a rhythm number storage area corresponding to each of the plurality of parts is prepared in the RAM 12. A rhythm number of a system defining rhythm data pattern is stored in the rhythm number storage area for each part together with a chord progress data number. Thus, the user can easily produce a user defining rhythm data pattern from the following procedure. First, the user selects the desired part. Next, the rhythm which is used in the selected part is selected from among the plurality of system defining rhythm data patterns. The rhythm number corresponding to the selected rhythm is stored in the above rhythm number storage area which corresponds to the selected part. The user defining rhythm data pattern is produced by performing the above operations over all the plurality of parts. Therefore, the user specifies a rhythm number of one of a plurality of system defining rhythm data patterns which are stored in the pattern memory, and stores the specified rhythm number for each part of the desired rhythm data pattern, and as a result of this, the user can begin defining a new rhythm data pattern. Therefore, it is not necessary for the user to newly produce a data pattern from a sequence of note data and it is possible for the user to easily produce a unique personal automatic accompaniment pattern.

In the automatic accompaniment, a rhythm number stored in the rhythm number register is first read out. Then, the rhythm data pattern corresponding to the rhythm number is read from the pattern memory. In this case, the chord is developed in accordance with the chord progress data corresponding to the rhythm number of a specific part, e.g., the chord part in the above-mentioned embodiment and the accompaniment sound is generated based on the data of the chord was developed. On the other hand, the rhythm data of parts other than the specific part are directly used to generate the accompaniment sound. In this manner, the automatic accompaniment sound which has a rhythm is generated in accordance with a predetermined chord progress by executing the above operation in order over all the parts. The automatic accompaniment can be performed in accordance with the chord progress data which is stored in a memory. Therefore, the user does not need to specify the chord and can concentrate on the melody performance. In this manner, according to this automatic accompaniment apparatus of the present invention, even if the user is a beginner, the user can enjoy the desired personal automatic accompaniment in accordance with a predetermined chord progression.

Note that it is possible to construct the automatic accompaniment apparatus such that the user can select the chord progress data. In this case, a determination step of whether or not the flag CBFLG is "1" is added after the step S43 of the panel processing routine, and if the flag CBFLG is "1", a value inputted from the SELECT switch may be related as a chord progress data number to the currently designated part. If the flag CBFLG is "0", the step S45 is executed. In this manner, the automatic accompaniment can be performed with unique rhythm and unique chord progress.

Further, in the above embodiment, each part of the system defining rhythm data pattern stores a sequence of note data. However, each of sequences of note data may be assigned with an identifier and each part of the system defining rhythm data pattern may store the identifier of the sequence of note data. In this case, each part of the user defining rhythm data pattern may store not only the rhythm number of the system defining rhythm data pattern but also the identifier of the sequence of note data.

In accordance with the automatic accompaniment apparatus of the present invention, if chord progress data is designated in association with the rhythm number of the specific part, the automatic accompaniment progresses in accordance with the chord progress data. However, if the chord progress data is not designated, the automatic accompaniment is performed based on only the rhythm data pattern. Therefore, when the user wants to perform the automatic accompaniment while specifying the chord, as in the conventional automatic accompaniment apparatus, the designation of the chord progress data can be cancelled.

According to the automatic accompaniment apparatus of the present invention, a timbre number which specifies a timbre of each part, and a tempo data which specifies a tempo are stored in addition to the rhythm number of each part. Therefore, the automatic accompaniment can be performed with a desired timbre and a desired tempo.

As described in detail, according to the present invention, the user can easily produce a desired automatic accompaniment pattern even if the user is a beginner, and the automatic accompaniment can be performed in accordance with a chord progress.

What is claimed is:

1. A method of automatically performing an accompaniment produced by a user in an automatic accompaniment apparatus, comprising the steps of:

providing a plurality of system defining rhythm data patterns, each of which is allocated a pattern number and is composed of a plurality of parts, each of said plurality of parts having the pattern number;

providing a plurality of note data sets, each of which is associated with at least one of said plurality of parts of said plurality of system defining rhythm data patterns;

providing a plurality of chord progress data sets, each of which is allocated with a chord progress data number;

producing, in an edit mode, a user defining rhythm data pattern which is composed of a plurality of parts, said pattern number and said chord progress data number being designated for each of said plurality of parts of said user defining rhythm data pattern and being stored in a table;

referring to said table to determine said pattern number and said chord progress data number for each of said plurality of parts;

determining one of said plurality of chord progress data sets based on said determined chord progress data number;

referring to one of said plurality of system defining rhythm data patterns based on the determined pattern number to determine one of said plurality of note data sets for the corresponding part of said user defining rhythm data pattern; and automatically performing an accompaniment in an automatic accompaniment mode based on the determined note data set and the determined chord progress data set for each of said plurality of parts of said user defining rhythm data pattern.

2. A method according to claim 1, wherein said producing step includes:

designating said pattern number for each of said plurality of parts of said user defining rhythm data pattern in the edit mode.

3. A method according to claim 2, wherein said designating step includes:

designating said pattern number by a key input and designating said each part by operating one of a plurality of part designation buttons which are provided for the plurality of parts, respectively.

4. A method according to claim 1, wherein said table stores a plurality of said user defining rhythm data patterns, and wherein said method further comprises the step of:

specifying a pattern number corresponding to one of said plurality of said user defining rhythm data patterns in an edit mode in response to an instruction, and wherein said automatically performing step includes:

automatically performing the accompaniment based on said user defining rhythm data pattern corresponding to said pattern number currently specified, in the edit mode.

5. A method according to claim 4, further comprising specifying a timbre for at least one of said plurality of parts of said user defining rhythm data pattern, and wherein said step of automatically performing includes automatically performing the accompaniment based on said user defining rhythm data pattern using the specified timbres in the automatic accompaniment mode.

6. A method according to claim 4, further comprising the step of specifying a tempo for said produced user defining rhythm data pattern, and wherein said step of automatically performing includes automatically performing the accompaniment based on said user defining rhythm data pattern using the specified tempo in the automatic accompaniment mode.

7. A method according to claim 2, wherein each of said plurality of patterns of said user defining rhythm data pattern is previously linked with one of said plurality of chord progress data sets.

8. A method according to claim 2, wherein said designating step includes designating said chord progress data number in addition to said pattern number for each of said plurality of parts of said user defining rhythm data pattern.

9. An automatic accompaniment apparatus comprising:

first storage means for storing a plurality of system defining rhythm data patterns, each of which is allocated a pattern number and is composed of a plurality of parts, each of said plurality of parts having the pattern number;

second storage means for storing a plurality of note data sets, each of which is associated with at least one of said plurality of parts of said plurality of system defining rhythm data patters;

third storage means for storing a plurality of chord progress data sets, each of which is allocated with a chord progress data number;

a table for storing a user defining rhythm data pattern which is composed of a plurality of parts, said pattern number and said chord progress data number being designated for each of said plurality of parts of said user defining rhythm data pattern; and performing means for referring to said table to determine said pattern number and said chord progress data number for each of said plurality of parts, for determining one of said plurality of chord progress data sets based on said determined chord progress data number, for referring to one of said plurality of system defining rhythm data patterns based on the determined pattern number to determine one of said plurality of note data sets for the corresponding part of said user defining rhythm data pattern, and for automatically performing an accompaniment based on the determined note data set and the determined chord progress data set for each of said plurality of parts of said user defining rhythm data pattern in an automatic accompaniment mode.

10. An automatic accompaniment apparatus according to claim 9, further comprising editing means for designating, in an edit mode, said pattern number for each of said plurality of parts of said user defining rhythm data pattern, wherein each of said plurality of patterns of said user defining rhythm data pattern is previously linked with one of said plurality of chord progress data sets.

11. An automatic accompaniment apparatus according to claim 9, further comprising editing means for designating, in an edit mode, said pattern number and said chord progress data number for each of said plurality of parts of said user defining rhythm data pattern.

12. An automatic accompaniment apparatus according to claim 9, wherein said table stores a plurality of said user defining rhythm data patterns, and said automatic accompaniment apparatus further comprises editing means for specifying one of said plurality of said user defining rhythm data patterns in an edit mode in response to an instruction, and said performing means automatically performs the accompaniment based on one of said plurality of user defining rhythm data patterns corresponding to said user defining rhythm data pattern corresponding to the pattern number currently specified as valid.

13. An automatic accompaniment apparatus according to claim 12, wherein said editing means further includes means for specifying a timbre for at least one of said plurality of parts of said user defining rhythm data pattern.

14. An automatic accompaniment apparatus according to claim 12, wherein said editing means further includes means for specifying a tempo for said user defining rhythm data pattern having the currently specified pattern number.

* * * * *

UNITED STATES PATENT AND TRADEMARK OFFICE

CERTIFICATE OF CORRECTION

PATENT NO. : 5,739,456
DATED : April 14, 1998
INVENTOR(S) : Yoshihisa Shimada

It is certified that error appears in the above-indentified patent and that said Letters Patent is hereby corrected as shown below:

Column 1, line 57, before "electronic" delete "an".
Column 5, line 46, change "base" to -- bass --.
Column 6, line 1, change "port" to -- part --.
Column 6, line 4, after "1" insert a period.
Column 6, line 7, change "da~a" to -- data --.
Column 6, line 26, change "Other" to -- other --.
Column 6, line 27, after "1" insert a period.
Column 7, line 11, after "data" delete "pattern".
Column 8, line 34, change "firsts" to -- first --.
Column 9, lines 14-17, the paragraph for "(l)" should be inset the same as paragraphs "(k)"and "(m)".
Column 10, line 30, change "accom~animent" to -- accompaniment --.
Column 10, line 39, after "RYMFLG" insert a period.
Column 10, line 62, change "numeral" to -- numerical --.
Column 12, line 37, before "are sent" delete "5".
Column 12, line 45, change "event~but" to -- event but --.
Column 12, line 56, after "when" insert -- the --.
Column 12, line 58, change "(step s13)" to -- (step S13) --.
Column 13, line 23, change "exclusive-0R" to -- exclusive OR --.
Column 13, line 38, change "(step s22)" to -- (step S22) --.
Column 13, line 42, change "(.step s23)" to -- (step S23) --.
Column 13, line 59, change "panels-process" to -- panels process --.
Column 14, line 9, change "(step s27)" to -- (step S27) --.
Column 14, line 24, change "(step s28)" to -- (step S28) --.

UNITED STATES PATENT AND TRADEMARK OFFICE

CERTIFICATE OF CORRECTION

PATENT NO. : 5,739,456
DATED : April 14, 1998
INVENTOR(S) : Yoshihisa Shimada

It is certified that error appears in the above-indentified patent and that said Letters Patent is hereby corrected as shown below:

Column 14, line 38, change "(step s30)" to -- (step S30) --.
Column 14, line 47, change "chordspart" to -- chords part --.
Column 15, line 27, change "(step s36)" to -- (step S36) --.
Column 15, line 40, change "(step s38)" to -- (step S38) --.
Column 15, line 62, change "determined' " to -- determined --.
Column 15, line 65, change "(step s42)" to -- (step S42) --.
Column 16, line 24, change "rhythm-number" to -- rhythm number --.
Column 16, line 32, change "Progress" to -- progress --.
Column 16, lines 55,56, change "(step s49)" to -- (step S49) --.
Column 17, line16, change "(step s60)" to -- (step S60) --.
Column 17, line 18, change "maode" to -- mode --.
Column 17, line 20, change "(step s61)" to -- (step S61) --.
Column 17, line 28, after "when" insert -- the --.
Column 17, line 52, change "(step s65)" to -- (step S65) --.
Column 17, line 62, change "timber" to -- timbre --.
Column 17, line 63, change "addressset" to -- address set --.
Column 18, line 16, change "This" to -- this --.
Column 19, line 4, change "to the zero" to -- to "0" --.
Column 19, line 25, change "process. in" to -- process. In --.

UNITED STATES PATENT AND TRADEMARK OFFICE

CERTIFICATE OF CORRECTION

PATENT NO. : 5,739,456

DATED : April 14, 1998

INVENTOR(S) : Yoshihisa Shimada

It is certified that error appears in the above-indentified patent and that said Letters Patent is hereby corrected as shown below:

Column 20, line 51, after "routine" insert -- to --.
Column 21, line 2, replace "changed into" with -- changed into "B". --.
Column 24, line 18, change "patters" to -- patterns --.

Signed and Sealed this

Twenty-seventh Day of July, 1999

*Attest:*

Q. TODD DICKINSON

*Attesting Officer*

*Acting Commissioner of Patents and Trademarks*